US011649961B2

(12) United States Patent
Carroll et al.

(10) Patent No.: US 11,649,961 B2
(45) Date of Patent: May 16, 2023

(54) LOW $NO_x$ AND CO COMBUSTION BURNER METHOD AND APPARATUS

(71) Applicant: John Zink Company, LLC, Tulsa, OK (US)

(72) Inventors: Chad Carroll, Tulsa, OK (US); Jaime Erazo, Tulsa, OK (US); Valeriy Smirnov, Tulsa, OK (US); Thomas Korb, Owasso, OK (US); Mark Vaccari, Tulsa, OK (US); Sean Battisti, Broken Arrow, OK (US); Jose Corcega, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 344 days.

(21) Appl. No.: 16/638,831

(22) PCT Filed: Sep. 5, 2018

(86) PCT No.: PCT/IB2018/056780
§ 371 (c)(1),
(2) Date: Feb. 13, 2020

(87) PCT Pub. No.: WO2019/049046
PCT Pub. Date: Mar. 14, 2019

(65) Prior Publication Data

US 2020/0191385 A1 Jun. 18, 2020

Related U.S. Application Data

(60) Provisional application No. 62/690,185, filed on Jun. 26, 2018, provisional application No. 62/554,327, filed on Sep. 5, 2017.

(51) Int. Cl.
*F23D 14/02* (2006.01)
*F23D 14/64* (2006.01)
(Continued)

(52) U.S. Cl.
CPC ..... *F23D 14/02* (2013.01); *F23D 14/64* (2013.01); *F23C 6/047* (2013.01); *F23C 9/00* (2013.01);
(Continued)

(58) Field of Classification Search
CPC ..... F23N 5/18; F23N 2221/10; F23N 2900/05003; F23D 14/64; F23D 14/02;
(Continued)

(56) References Cited

U.S. PATENT DOCUMENTS 5,407,345 A 4/1995 Robertson et al.
5,605,452 A 2/1997 Robertson et al.
(Continued)

FOREIGN PATENT DOCUMENTS

CN 201903058 U 7/2011
CN 103486572 A 1/2014
(Continued)

OTHER PUBLICATIONS

CN First office action received for application No. 201880057140.9, dated Dec. 14, 2021, pp. 13 (7 pages of English translation and 6 pages of original document).
(Continued)

*Primary Examiner* — Alfred Basichas

(57) ABSTRACT

Emissions of $NO_X$ and/or CO are reduced at the stack by systems and methods wherein a primary fuel is thoroughly mixed with a specific range of excess combustion air. The primary fuel-air mixture is then discharged and anchored within a combustion chamber of a burner. Further, the systems and methods provide for dynamically controlling $NO_X$ content in emissions from a furnace by adjusting the flow of primary fuel and of a secondary stage fuel, and in some cases controlling the amount or placement of combustion air into the furnace.

8 Claims, 15 Drawing Sheets

(51) Int. Cl.

| | |
|---|---|
| *F23C 6/04* | (2006.01) |
| *F23C 9/00* | (2006.01) |
| *F23D 14/70* | (2006.01) |
| *F23D 17/00* | (2006.01) |

(52) U.S. Cl.
CPC .... *F23C 2900/06041* (2013.01); *F23D 14/70* (2013.01); *F23D 17/002* (2013.01); *F23D 2207/00* (2013.01); *F23D 2900/14021* (2013.01); *F23N 2900/05003* (2013.01)

(58) Field of Classification Search
CPC ..... F23D 2207/00; F23D 14/70; F23D 2900/14021; F23D 17/002; F23C 9/00; F23C 6/047; F23C 2900/06041
See application file for complete search history.

(56) References Cited

U.S. PATENT DOCUMENTS

| | | | | |
|---|---|---|---|---|
| 7,878,798 | B2 * | 2/2011 | Poe | F23D 14/08 431/351 |
| 10,229,572 | B1 | 3/2019 | Casey et al. | |
| 2002/0064740 | A1 * | 5/2002 | Venizelos | F23D 14/08 431/9 |
| 2005/0175945 | A1 | 8/2005 | Chung et al. | |

FOREIGN PATENT DOCUMENTS

| | | | |
|---|---|---|---|
| DE | 3419891 | A1 | 11/1985 |
| EP | 0562710 | A2 | 9/1993 |
| WO | 2019/049046 | A2 | 3/2019 |

OTHER PUBLICATIONS

International Preliminary Report on Patentability received for PCT Application No. PCT/IB2018/056780, dated Mar. 19, 2020, 15 pages.
Office action received for SA application No. 520411463, dated Jan. 13, 2022, pp. 9 (4 pages of English translation and 5 pages of official notification).
International search report and written opinion for PCT application No. PCT/IB2018/056780, dated Mar. 6, 2019, 19 pages.

* cited by examiner

LOW $NO_x$ AND CO COMBUSTION BURNER METHOD AND APPARATUS

CROSS-REFERENCE TO RELATED APPLICATIONS

This application claims the benefit of U.S. Provisional Application No. 62/554,327 filed Sep. 5, 2017, and U.S. Provisional Application No. 62/690,185 filed Jun. 26, 2018, which are hereby incorporated by reference.

FIELD

This disclosure relates to burner apparatuses and methods for burning fuel-air mixtures, whereby flue gases having low $NO_X$ and CO are produced.

BACKGROUND

Because of stringent environmental emission standards adopted by government authorities and agencies, burner apparatus and methods have heretofore been developed which suppress the formation of nitrogen oxides ($NO_X$) in flue gases produced by the combustion of fuel-air mixtures. For example, burner apparatuses and methods wherein liquid or gaseous fuel is burned in less than a stoichiometric concentration of air to lower the flame temperature and thereby reduce thermal $NO_X$ have been developed. That is, staged air burner apparatuses and methods have been developed wherein the fuel is burned in a deficiency of air in a first combustion zone whereby a reducing environment which suppresses $NO_X$ formation is produced, and the remaining portion of the air is introduced into a second zone downstream from the first zone wherein the unburned remaining fuel is combusted.

Staged fuel burner apparatuses have also been developed wherein all of the combustion air is supplied and some of the fuel is burned in a first zone with the majority of fuel being burned in a second downstream zone. In such staged fuel burner apparatuses and methods, the second zone is diluted with furnace flue gases prior to mixing with excess air from the first zone, thereby reducing the formation of thermal $NO_X$.

While staged fuel burners which produce flue gases containing low levels of $NO_x$ have been utilized heretofore, there continue to be needs for improved burner apparatuses having a larger range of operation producing flue gases having consistently lower $NO_X$ and CO emission levels and improved methods of using the burner apparatus.

SUMMARY OF THE INVENTION

Embodiments of this disclosure relate to systems and methods of controlling $NO_X$ and/or CO content in emissions from a furnace. Generally, the emissions will be determined at the furnace stack. As used herein, "stack" or "furnaces stack" includes any point downstream of the furnace combustion zones where emission and excess oxygen content of the flue gases can be measured. Typically, this point will be in the stack or exit flue of the radiant section of the furnace but in some embodiments could be a zone within the furnace but outside of the combustion zones, or could be a zone just downstream from the exit flue of the furnace.

Broadly, the emissions of $NO_X$ and/or CO can be reduced at the stack by thoroughly mixing a primary fuel with a specific range of excess combustion air prior to combustion, which is in excess of the amount required for stoichiometric burning of the primary fuel, to minimize thermal and prompt $NO_X$ emissions. The primary fuel-air mixture is then discharged and anchored within a combustion chamber of a burner. Anchoring the primary fuel-air mixture flame within the combustion chamber of the apparatus does not allow the heat produced by the flame to transfer immediately to the surrounding furnace environment, but instead uses the heat generated with enough residence time in the combustion chamber to minimize drastically the $NO_X$ and/or CO emissions. The $NO_X$ and CO levels resulting from this configuration relatively decouple the emissions performance of the primary flame from the surrounding flue gas environment of the furnace. With prior art combustion devices, the hotter the surrounding furnace environment, the higher $NO_X$ and lower CO. Additionally, with prior art combustion devices, the colder the surrounding furnace environment, the lower the $NO_X$ and higher the CO. The current embodiments avoid these issues.

More specifically, these issues are avoided by a method of discharging fuel and an amount of air into a furnace space wherein the fuel is burned such that flue gases having low $NO_X$ content and low CO content are formed therefrom, the method comprises the steps of:

- mixing a first portion of the fuel and substantially all of the air to form a lean primary fuel-air mixture;
- discharging the lean primary fuel-air mixture into the furnace space within a primary combustion zone defined by a burner tile such that there is a furnace environment surrounding the burner tile;
- burning the primary fuel-air mixture in the primary combustion zone to produce a flame and thus generated flue gases, wherein the primary combustion zone has a first end and a second end, and the lean primary fuel-air mixture is introduced so that the flame is anchored adjacent the first end and the generated flue gases are discharged into the furnace environment at the second end.

Additionally, the issues are avoided in a fuel gas burner apparatus comprising a plenum, a burner tile, a plurality of flame holders, a plurality of primary fuel tips, a plurality of primary tubes and a plurality of secondary fuel tips.

The plenum includes a first end attached to a furnace, a second end opposing the first end; and a sidewall connecting the first end and the second end together. At least one of the sidewall and the second end has an air inlet disposed therein.

The burner tile includes a base attached to the upper end of the plenum, a discharge end opposing the base, the discharge end defining a discharge outlet, and a wall connecting the base to the discharge end and surrounding the discharge outlet. The wall extends into the furnace, and has an interior surface defining a primary combustion chamber and an exterior surface.

The plurality of flame holders is located within the combustion chamber. The plurality of primary fuel tips extends into the plenum. The primary tubes include a first portion. Each primary tube in the first portion has an introduction end located within the plenum and a discharge end located within the primary combustion chamber. The first portion of primary tubes are associated with the plurality of primary fuel tips such that fuel from the primary fuel tips flows into the introduction ends of the first portion of primary tubes and draws air from inside the plenum into the introduction end so as to generate a fuel-air mixture. The discharge end is located relative to the flame holders such that fuel-air mixture is introduced into the primary combustion chamber through the discharge end so as to encounter the flame holder.

Also, the bottom end of the tile and the upper end of the plenum are closed to airflow such that air does not pass from the plenum to the tile except through one or more of the primary tubes.

The plurality of secondary fuel tips are connected to a source of fuel gas and operably associated with the burner apparatus such that secondary stage fuel gas is injected from outside of the burner tile to a point downstream from the discharge outlet of the burner tile.

Embodiments of the above methods and apparatuses can further include systems and processes of dynamically controlling $NO_X$ content in emissions from a furnace incorporating the above methods and apparatuses. While these systems and processes can be used with other burners and burner operation methods than those described above, they can be particularly effective in use with the above described methods and apparatuses.

The systems and processes adjust for furnace system changes that result in variations in $NO_X$ and CO emissions. In many applications, the fuel composition can change during operation of the furnace. Due to the changing composition of the fuel, there is variation in the $NO_X$ and CO emissions. Additional variations that drive variations in $NO_X$ and CO emissions are combustion air conditions such as relative humidity in the air, as well as flue gas temperatures within the firebox surrounding the burner flames. All of these conditions ultimately cause large variations in $NO_X$ and CO emissions.

Broadly, these systems and processes of controlling emissions can comprise steps of:

- determining the composition of the primary fuel and secondary fuel;
- determining a flow rate of primary fuel into the system and a flow rate of secondary fuel into the system;
- determining an adiabatic flame temperature (first AFT) for the combustion of the primary fuel and the secondary fuel;
- determining the excess air quantity required to produce a predetermined $NO_X$ based on the first AFT and second AFT; and;
- adjusting at least one of the flow rate of primary fuel, the flow rate of secondary fuel, the primary amount of air based on the excess air quantity required to minimize $NO_X$, and the distribution of air within the burner.

In some of the embodiments, the adjusting step is at least to both the flow rate of the primary fuel and the flow rate of the secondary fuel, and optionally the adjusting is to both the flow rate of the primary fuel and the flow rate of the secondary fuel simultaneously.

The system and process can utilize sensors to determine the composition of the primary fuel and secondary fuel, to measure the flow rates of the primary and secondary fuel. Additionally, sensors can be used to measure the flame temperatures at various positions in the furnace or burner, and to measure the $NO_X$, CO and excess air quantity in the furnace stack.

Various valves and actuators can be used to control the flow of fuel and air into the furnace. A computer processing system can be used to calculate conditions for the furnace and apparatus, and more specifically for the burner. For example, the AFT can be calculated based on fuel composition, and air quantities. Additionally, the target AFT to minimize $NO_X$ can be calculated based on experimental curve data.

BRIEF DESCRIPTION OF THE DRAWINGS

FIG. 6 is a schematic illustration of a furnace using a burner system in accordance with a fourth embodiment.

FIG. 8 schematically illustrates one possible placement of staged fuel tips in relation to burner tiles in the wall of a furnace.

FIG. 16 is a top view of the ignition unit of FIG. 15.

FIG. 18 is an example of an excess air (Lambda) versus adiabatic flame temperature curve for one fuel composition.

FIG. 19 is a schematic illustration of a system for carrying out the process of FIG. 17.

DESCRIPTION

Figure 1:
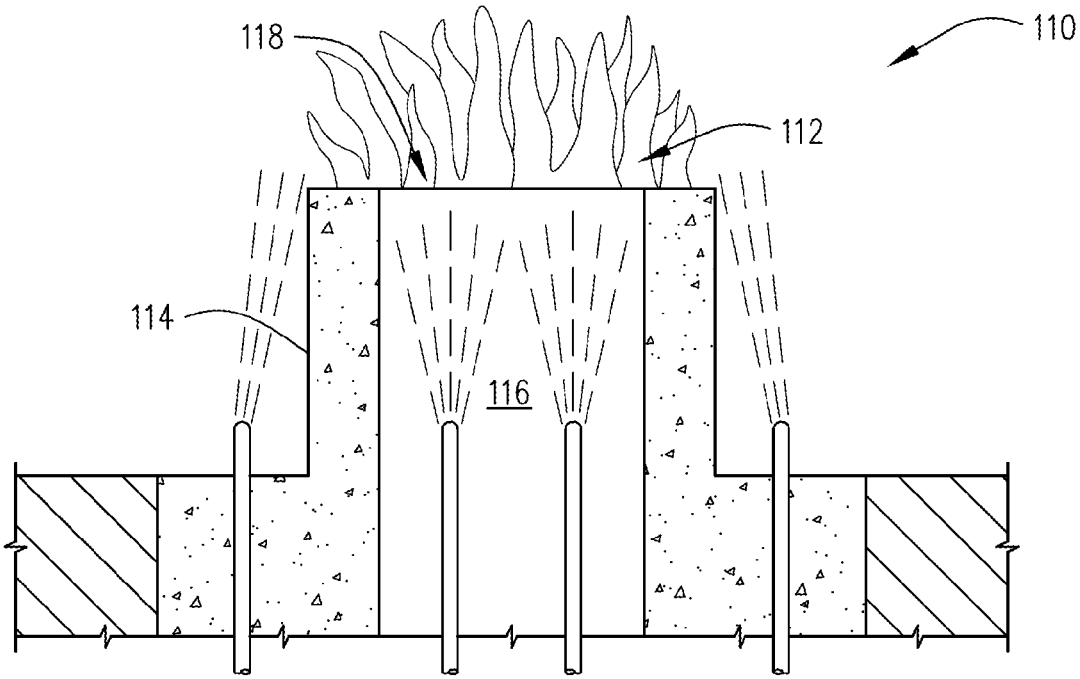
FIG. 1 PRIOR ART
FIG. 1 is a schematic illustration of traditional prior art flame anchoring in a simplified burner tile.

The present disclosure may be understood more readily by reference to the following description including the examples. In addition, numerous specific details are set forth in order to provide a thorough understanding of the embodiments described herein. However, those of ordinary skill in the art will understand that the embodiments described herein can be practiced without these specific details. In other instances, methods, procedures and components have not been described in detail so as not to obscure the related relevant feature being described. Additionally, the description is not to be considered as limiting the scope of the embodiments described herein.

In the drawing, various embodiments are illustrated and described wherein like reference numbers are used herein to designate like elements throughout the various views. The figures are not necessarily drawn to scale, and in some instances the drawings have been exaggerated and/or simplified in places for illustrative purposes only. Where components of relatively well-known designs are employed, their structure and operation will not be described in detail. One of ordinary skill in the art will appreciate the many possible applications and variations of the present invention based on the following description.

This disclosure is directed to combustion methods and apparatuses designed to achieve low oxides of nitrogen and carbon monoxide emissions from start-up (cold furnace conditions) to maximum burn rate (design conditions). It achieves unique emissions performance by targeting specific burner conditions, such as targeting specific flame temperatures by premixing fuel with a pre-determined air flow which is in excess of the stoichiometric amount needed for combustion of the fuel and by isolating the apparatus performance from the influence of the surrounding environment by anchoring the flame in a specifically designed combustion chamber providing an adequate residence time for carbon monoxide emissions reduction.

Systems and processes of this disclosure are generally applicable to a furnace of the type wherein a primary fuel is combusted in a primary combustion zone with an amount of air. The systems and processes are particularly applicable where, in addition to the primary combustion zone, a secondary fuel is combusted in a secondary combustion zone. Typically, the secondary fuel is combusted with excess air from the primary combustion zone; however, the system and processes are also applicable to furnaces in which additional air is added for the secondary fuel combustion.

Generally in many of the embodiments, a primary fuel is thoroughly premixed within a specific range of combustion air, which is in excess of the amount required for stoichiometric burning of the primary fuel to minimize thermal and prompt $NO_X$ emissions. The resulting primary fuel-air mixture is then discharged and anchored within a combustion chamber of the burner tile. Anchoring the primary flame within the combustion chamber of the burner tile does not allow the heat produced by the flame to transfer immediately to the surrounding furnace environment, but instead uses the heat generated with enough residence time achieved by an appropriately sized combustion chamber to minimize drastically the CO emissions. The $NO_X$ and CO levels resulting from this configuration relatively decouple the emissions performance of the primary premix flame from the surrounding atmosphere of the furnace. In the marketplace currently, $NO_X$ and CO emissions are very dependent on the surrounding environment conditions and are relatively variable as a result, especially at start-up and turndown conditions. With other combustion devices, the hotter the surrounding environment, the higher $NO_X$ and lower CO. Additionally with other combustion devices, the colder the surrounding environment, the lower the $NO_X$ and higher the CO. The current embodiments avoid these issues For example, FIG. 1 illustrates a simplified burner 110 for furnaces utilizing a traditional prior-art flame anchoring. In burner 110, flame anchoring 112 occurs at the top of a burner tile 114 and the flame length itself is well protruded from burner tile 114 into the furnace chamber. Accordingly, the majority, if not all, of the combustion occurs outside the burner tile (outside combustion chamber 116) where it is exposed to (and entrains) the furnace flue gases. While not wishing to be bound by theory, it is believed that such configurations result in the combustion being exposed to the lower temperature of the surrounding furnace environment, thus resulting in quenching of the flame envelope, and thus additional generation of CO and the presence of CO in the flue gases in amounts greater than 400 ppm corrected to 3% of O2, and in some cases greater than 500 ppm CO, greater 600 ppm CO, or even greater than 800 ppm CO corrected to 3% O2.

Figure 2:
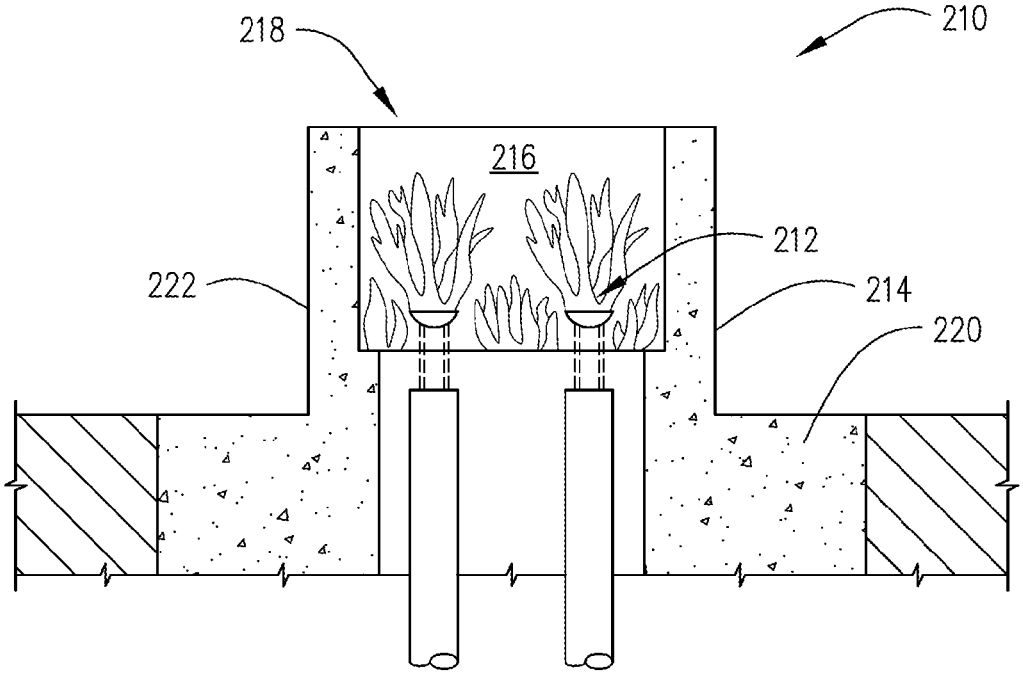
FIG. 2 is a schematic illustration of a simplified configuration in accordance with the current disclosure where flame anchoring is inside the combustion chamber (inside the burner tile).
Figure 3:
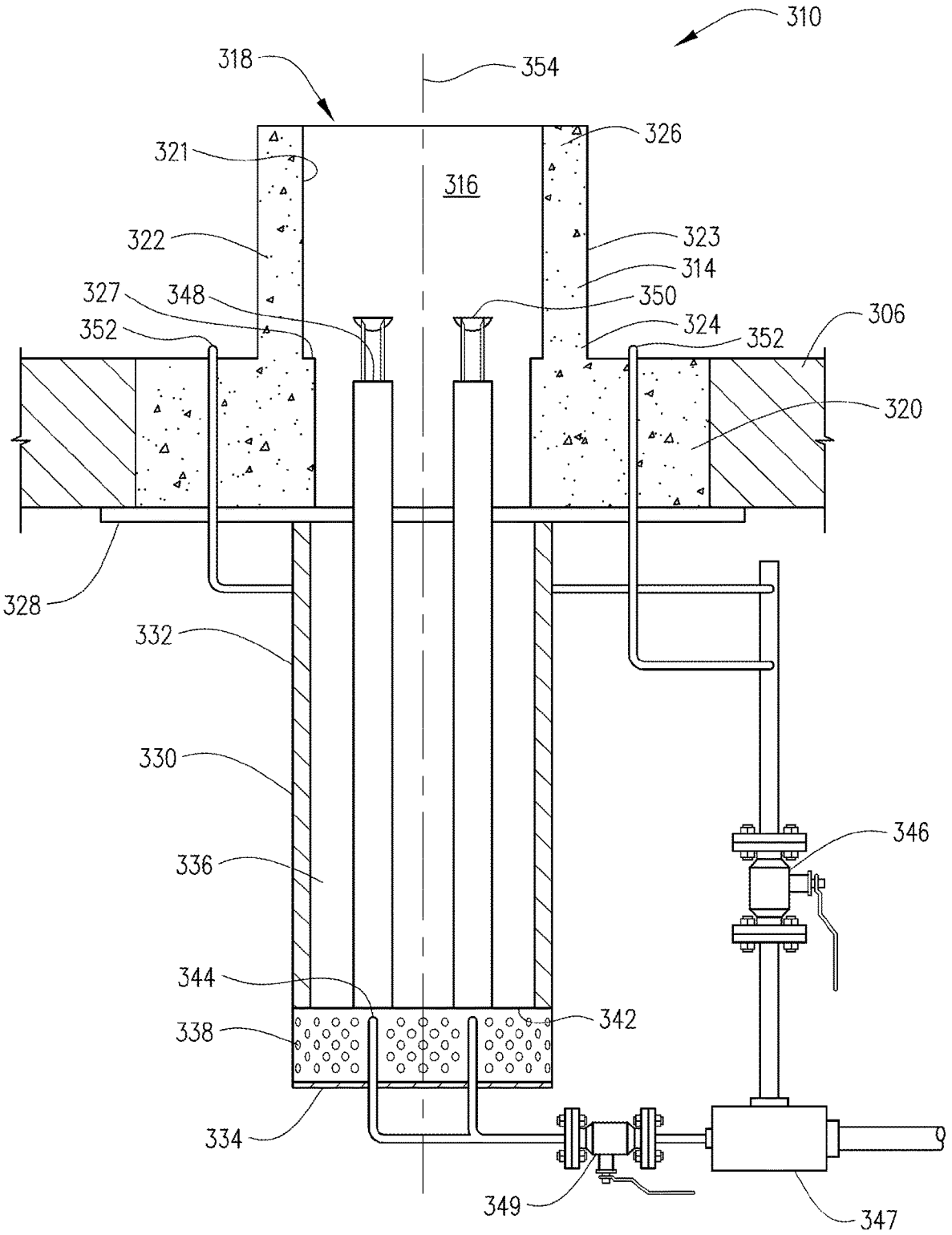
FIG. 3 is a schematic illustration of a burner in accordance with an embodiment of this disclosure.
Figure 4:
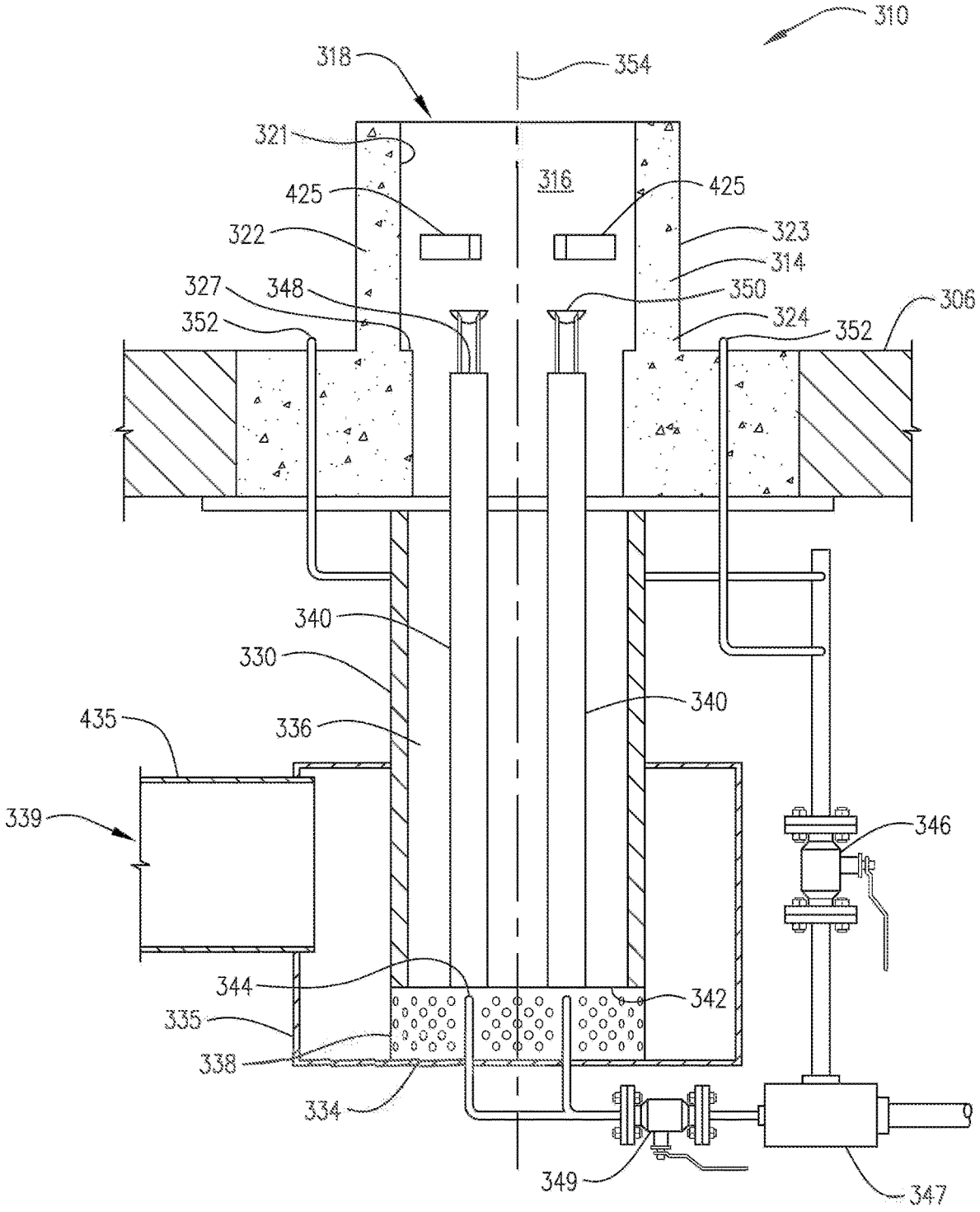
FIG. 4 is a schematic illustration of a burner in accordance with a second embodiment of this disclosure.

In comparison, some embodiments of this disclosure utilize flame anchoring at the bottom of a combustion chamber defined by a burner tile contained inside a furnace, as illustrated in FIG. 2. In FIG. 2, a simplified burner 210 is illustrated. Burner 210 is designed (as further described below) to have flame anchoring 212 occur inside the combustion chamber 216 defined by burner tile 214. The illustrated configuration of FIG. 2 is simplified and rendered similar to FIG. 1 for direct comparison, and FIG. 2 illustrates flame anchoring inside the combustion chamber 216 or inside the burner tile 214 rather than at the top of the burner tile 114 or at the exit aperture 118 of the burner tile, as is illustrated in FIG. 1. In some embodiments, the burner tile can have an extended body (such as illustrated in FIGS. 3 and 4) so as to enlarge the burner chamber and increase residence time of the fuel-air mixture and generated flue gas. As can be seen from FIG. 2, a combustion chamber is defined by the burner tile 214, which is the volume from the base 220 of the burner tile up to the exit aperture 218 at the top of the burner tile. Thus, the combustion within the combustion chamber 216 is shielded from the surrounding furnace environment by tile wall 222.

Embodiments using the low flame anchoring described above and/or other principles discussed herein utilize longer residence time for the fuel-air mixture and flue gases in the primary combustion zone shielded from the surrounding furnace environment. Traditionally, burners stage most of the fuel on the outside of the tile. Traditional burners that mix some of the fuel and air, and launch it within the burner tile have extremely small residence times, if any, where the fuel-air mixture and resulting flue gases are shielded from the surrounding furnace environment. Many of the current apparatuses and methods can result in a residence time of at least 0.01 seconds.

Particular embodiments coming under the current disclosure utilize a primary combustion chamber that decouples the emission performance of the primary combustion zone from the surrounding environment and burns the primary flame in a way and at a temperature that allows for depressed prompt and thermal oxides of nitrogen and carbon monoxide emission levels. Generally, the present embodiments allow for $NO_X$ levels below 15 ppm corrected at 3% O2, and more typically below 10 ppm, below 9 ppm or below 5 ppm $NO_X$ corrected at 3% O2. At the same time, the present embodiments allow for CO levels below 400 ppm corrected at 3% O2, and more typically below 350 ppm, below 300 ppm, below 200 ppm, below 100 ppm or even below 50 ppm CO corrected at 3% O2. Additional emissions that may be reduced as a byproduct are UHC, VOC, and potentially PM10 or PM2.5. Additionally, these advantages can be achieved at all phases of operation of the current apparatuses and methods.

Accordingly, present embodiments have the advantage over prior systems in that they are capable of reduced oxides of nitrogen and carbon monoxide emissions at both start-up/turndown heat release (cooler furnace temperature operation) through maximum (design) heat release (hotter furnace temperature operation). Readily available solutions in the marketplace currently optimize reductions of oxides of nitrogen at design heat releases while sacrificing carbon monoxide emissions performance at start-up/turndown conditions. The embodiments described in this disclosure can meet more stringent oxides of nitrogen than is currently available in the marketplace as well as carbon monoxide emissions at both start-up/turndown and design heat release conditions.

Turning now to FIGS. 3 and 4, examples of an apparatus utilizing the methods and designs of this disclosure will now be further described. In these examples, a furnace utilizes a burner 310 comprising a burner tile 314, which is typically a refractory tile. Burner tile 314 has a base 320 mounted to a wall 306 of the furnace, which could be the floor, a side or the top of the furnace. Burner tile 314 has a wall 322 extending from the base 320 at a first end 324 to a second end 326 where exit aperture 318 is located. Tile wall 322 defines a combustion chamber 316. In the embodiments, the combustion chamber is generally shown as a cylinder and the tile wall typically has a cylindrical shape; however, the shapes may be different. For example, shapes having a rectangular, square or oval cross-section can be useful in some operating conditions. In the embodiment illustrated, first end 324 is closed off by mounting plate 328 so that flow in or out of combustion chamber 316 is limited to exit aperture 318 or through tubes extending through the mounting plate 328, as further described below.

Tile wall 322 of the embodiment of FIG. 3 extends along burner axis 354 and provides an uninterrupted wall defining combustion chamber 316; that is, the wall has no ports or apertures. Tile wall 322 of the embodiment of FIG. 4 has ports 425 which serve as pressure relief/recirculation windows. Ports 425 can be evenly placed on the circumference of the tile and at a small distance downstream of flame holders 350. The placement of the ports is between tubes 340 if viewed in a horizontal plane. These ports 425 can prevent excessive positive or negative pressure inside the tile combustion chamber, which can help to maintain flame stability. In the case of pressure fluctuation during changes of heat release, some small amount of combustion gases may be discharged out of ports 425 or a small amount of furnace atmosphere gases may be drawn inside the chamber. The apparatus of the several embodiments described in this disclosure may or may not be equipped with these windows.

A plenum 330 is fixed on mounting plate 328 on the opposite side from burner 314, and on the opposite side from where combustion air and fuel are introduced into combustion chamber 316. Plenum 330 has a solid plenum wall 332 extending from mounting plate 328 to plenum base 334. Plenum wall 332 defines an air chamber 336. Plenum base 334 has an opening 338 through which air can enter into air chamber 336, which can be a screened opening. The screen, which can be a perforated, restriction plate, surrounding the tube inlets 342 and primary fuel tips 344, improves air distribution to the tubes 340. Additionally, the screen can prevent dirt particles and debris from entering with the air. The plenum is thus configured to prevent air from entering air chamber 336 other than through opening 338. Additionally, air can only enter combustion chamber 316 from air chamber 336 through tubes 340 extending through mounting plate 328, as described below.

Inside the plenum 330 are a number of tubes 340 for introducing a fuel and air mixture into combustion chamber 316. Typically, there will be two or more such tubes, and there can be five or more tubes. As can be seen from FIGS. 8 and 9, certain embodiments have up to 10 tubes or more. Each tube's cross sectional profile may be round, elliptical, rectangular or in any other shape, such as a star.

Tubes 340 serve as the primary introduction of fuel-air mixture into the furnace for each such burner 310. An igniter (not shown in FIGS. 3 and 4) may be present in combustion chamber 316 to ignite the fuel. In the illustrated examples, the tubes are arranged in a circle and adjacent to the inside surface of the combustion chamber, as can be seen from FIGS. 8 and 9. Variable positioning with respect to each other and number of tubes inside the plenum and tile are possible and depends on burner size and operational requirements.

The illustrated tubes 340 are fuel-air mixing tubes in that at the inlet 342 of each tube is a primary fuel tip 344, which discharges a high momentum fuel jet from fuel distributer 349 and fuel source 347 into the associated tube 340 along the tube's longitudinal axis. The high momentum fuel jet entrains air from the plenum base 334 of plenum and promotes mixing between the air and fuel to produce a thoroughly mixed stream at outlet 348 of tubes 340. FIG. 3 shows a natural draft plenum without forced air. However, as illustrated in FIG. 4, the air may be entrained and/or forced by the use of a fan or blower in fluid flow contact with housing 435 surrounding opening 338 at plenum base 334. Thus, the fan provides a forced air supply to the plenum through an opening 339 in housing 435.

Outlet 348 of each tube 340 may be equipped with a flame holder 350 that is positioned at a fixed distance from outlet 348 and serves to aid in flame stabilization and anchoring. The flame stabilization/anchoring devices (flame holder 350) laterally spread out the incoming fuel and air mixture so that it can spread across interior surface 321 of the tile wall, which defines the combustion chamber, and can anchor on the interior surface 321 and inside base or ledge 327 of the burner tile. The flame stabilization/anchoring devices 350 also facilitate the production of vortexes for greater flame stabilization and anchoring.

Flame holder or flame stabilization/anchoring devices 350 can be configured in a variety of shapes, such as a cup, cone, honeycomb, ring, perforated disk. Additionally, embodiments can use other flame stabilization/anchoring devices and arrangements, such as bluff bodies, ledges built into the tile, or swirl can be employed.

While the above described fuel-air mixing tube introduction of fuel-air mixture is currently preferred, other delivery systems to provide thorough fuel-air mixing can be used. For example, the fuel-air mixture can be produced upstream of plenum 330 and introduced into tubes 340. In another example, the fuel and air may be provided separately to the combustion chamber and then "rapidly mixed" at the entrance of the combustion chamber, so long as the fuel and air can thoroughly mix to ignition and can anchor within the combustion chamber. Ways this can be achieved are through the use of high air pressure drop and/or swirling the air or fuel or both.

Near the level of furnace wall 306 and just outside tile wall 322, a number of additional raw gas fuel tips or staged fuel tips 352 are located (typically there will be four or more with eight or ten tips being not uncommon). Each staged fuel tip 352 can receive fuel from distributor 346 and fuel source 347, and each staged fuel tip 352 is designed to discharge the fuel jet outside the burner tile 314 in direction generally downstream from exit aperture 318 so as to create a secondary combustion zone outside of combustion chamber 316 and generally downstream of exit aperture 318. For example, the stage fuel tips 352 can discharge fuel along outer surface 323 of tile wall 322 in the direction of the flame stream under variable angles with respect to the longitudinal burner axis 354.

While FIGS. 3 and 4 only utilize staged fuel tips outside the burner tile, the current embodiments can be utilized with designs that also utilize primary fuel tips outside the burner tile. For example, some of the current embodiments can utilize a coanda design with fuel tips outside the burner tile as disclosed in U.S. Pat. No. 7,878,798, issued Feb. 1, 2011. In that patent, there are multiple tips for ignition fuel, and multiple tips for staged fuel outside the burner tile. Each ignition fuel tip is designed to discharge the fuel jet onto a Coanda profile window, which leads into the combustion chamber of the tile. The purpose of the ignition fuel is to provide some localized fuel rich spots within the combustion chamber with a minimal amount of heat release so that the overall emissions impact from the ignition fuel is minimized.

When such a combination of ignition fuel tips and staged fuel tips are used, they can be positioned in an alternating sequence on the same diameter circle. The distance between tips and number of tips may vary depending on the burner size. The tips also may be positioned in different locations around or within the burner. For example, ignition tips may be located close to Coanda profile windows, while the staged tips could be placed on a larger radius from the burner's axis. In another example, the staged tips may be remotely introduced to the firing atmosphere (furnace) in order to target specific heat flux or other operational or emissions (lower $NO_X$) requirements. In another example, the ignition tips may only be one or multiple ignition tips located within the combustion chamber itself. The ignition fuel and staged fuel zones designs may vary depending on design specifics.

Figure 5:
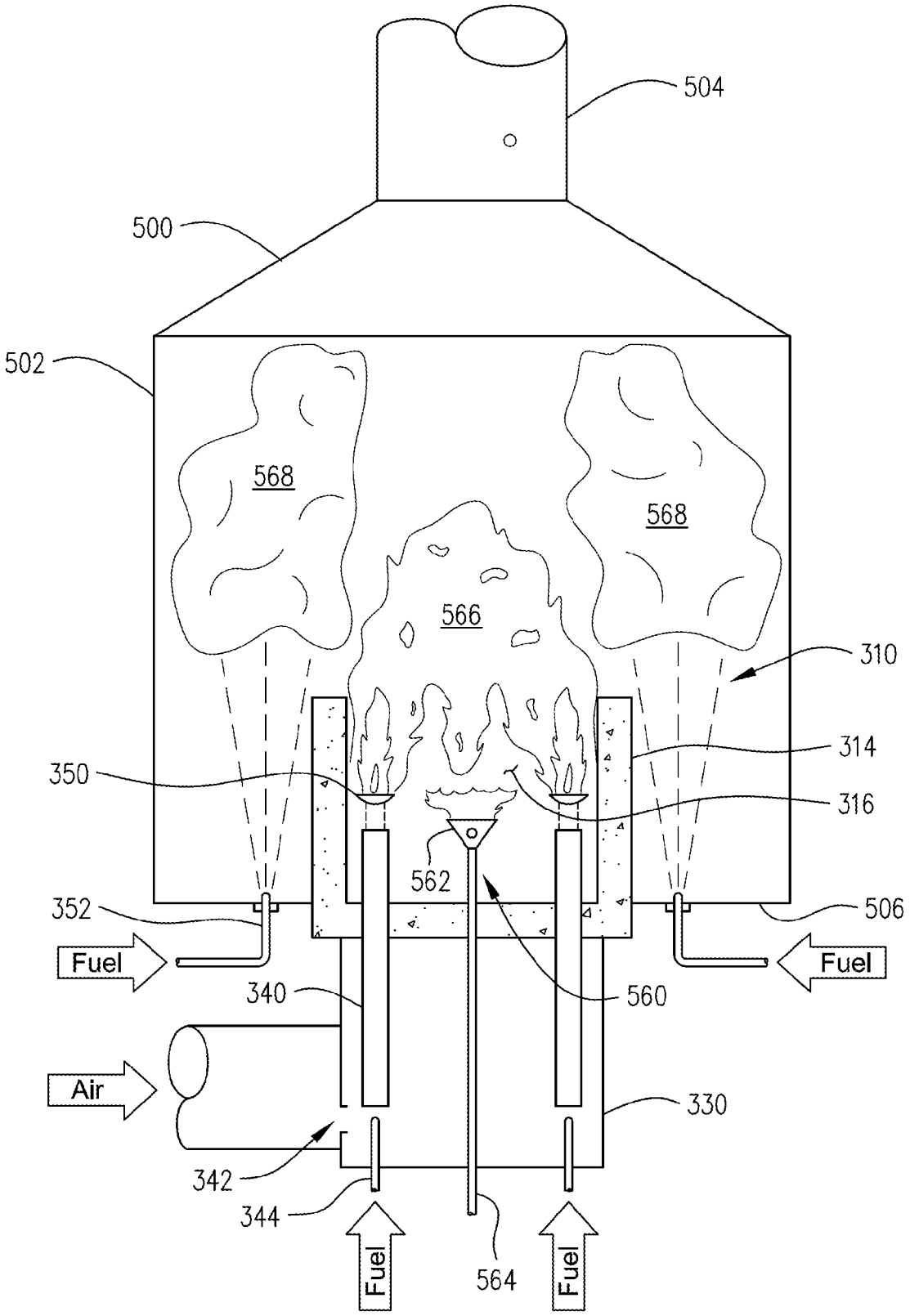
FIG. 5 is a schematic illustration of a furnace using a burner system in accordance with a third embodiment.
Figure 5:
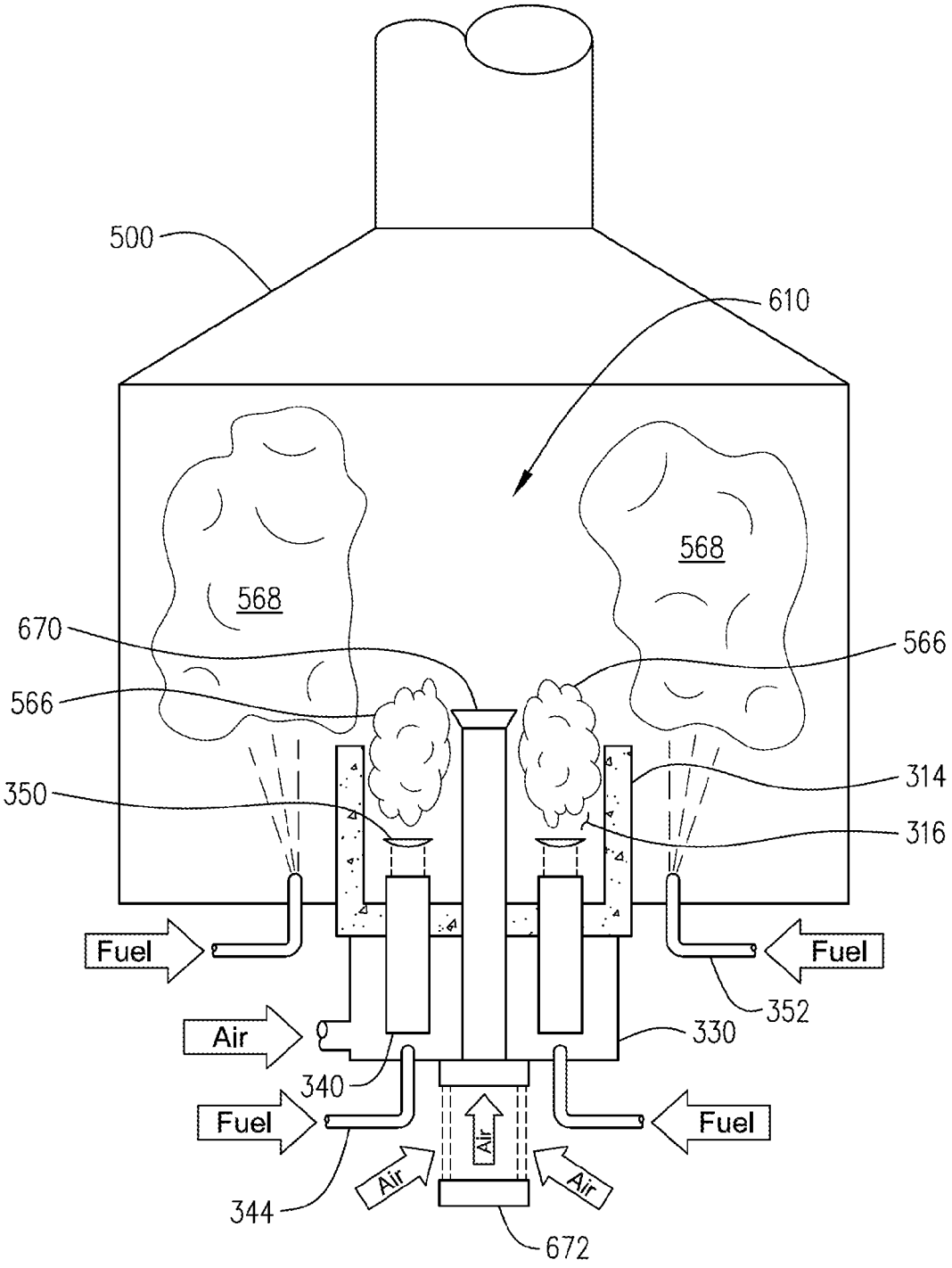

Turning now to FIG. 5, a third embodiment similar to FIGS. 3 and 4 is illustrated in relation to a furnace 500. Furnace 500 comprises a furnace housing 502 with a stack 504. The furnace at least partially contains a burner 310, which comprises a refractory tile 314 defining a combustion chamber 316 inside tile 314. Refractory tile 314 is fixed on the furnace housing 502. As shown, refractory tile 314 is fixed on a furnace wall, which in this case is furnace floor 506 but could be fixed to a sidewall of the furnace. Refractory tile 314 is also fixed to a plenum 330, which can also be fixed to furnace floor 506 on the outside. Plenum 330 has an air inlet 342, which is schematically illustrated and can be a natural draft arrangement or be a forced air supply arrangement.

As indicated, burner 310 further comprises ignition unit 560 (typically lighted by an igniter, not shown), tubes 340, flame holder 350 and primary fuel tips 344. An ignition end 562 of an ignition unit 560 is located within combustion chamber 316 and extends through plenum 330 to be attached to a fuel source (not shown) at a second end 564. Inside the plenum 330 are a number of tubes 340 that are discharged into the combustion chamber 316. The tubes 340 use entrainment principles to mix fuel and air as described above. Typically, tubes 340 will surround ignition unit 560; for example, five or six mixing tubes 340 can be positioned in a circle around ignition unit 560. The outlet of each tube 340 is equipped with a flame holder 350 that is positioned at a fixed distance from the tube outlet and serves to aid in flame stabilization and anchoring.

As was the case for FIGS. 3 and 4, the embodiment illustrated in FIG. 5 has a number of secondary or staged fuel tips 352 near the furnace floor level and just outside combustion chamber 316 formed by refractory tile 314. Each staged fuel tip 352 is designed to discharge the fuel jet into furnace 500 in the direction of the flame stream formed in combustion chamber 316. The fuel jets from fuel tips 352 can be parallel with the burner axis 354 or can be at variable angles with respect to burner axis 354.

As will be appreciated from FIG. 5, fuel from ignition unit 560 and fuel-air mixture from tubes 340 burn in combustion chamber 316 and immediately downstream from combustion chamber 316 so as to form a primary combustion zone 566. In some embodiments, the fuel for combustion in primary combustion zone 566 can be supplied solely by tubes 340 after start-up or ignition. In some embodiments, the combustion air or oxygen for combustion within furnace 500 is typically supplied solely through tubes 340 and is in excess to what is needed for stoichiometric combustion of the fuel from ignition unit 560 and tubes 340. Fuel from staged fuel tips 352 mixes with flue gas and the excess combustion air, then combusts in secondary combustion zone 568. Thus, primary combustion zone 566 is formed within combustion chamber 316 and can extend into the furnace just downstream from the end of the combustion chamber 316. Secondary combustion zone 568 is formed outside of primary combustion zone 566. Secondary combustion zone 568 will be in the furnace outside of burner tile 314, and will be generally downstream from the flame anchoring for the primary combustion zone 566 and can be downstream from the primary combustion zone 566. While secondary combustion zone can be directly downstream from the primary combustion zone 566, it is currently believed that it more typically would at least partially surround part of the primary combustion zone and could have a donut like shape or a cup like shape, and extend around the downstream portion of the primary combustion zone and downstream from the primary combustion zone.

As illustrated in FIG. 5, secondary fuel jets discharged from the staged tips 352 are directed in a generally downstream direction; that is, the direction the primary flame stream is moving. The secondary fuel jets gradually mix with the primary zone flame stream and burns while traveling through the furnace volume. Prior to mixing with the primary flame, these secondary staged fuel jets entrain and mix with furnace atmosphere gases, which are mostly inert species such as $CO_2$, $H_2O$, and $N_2$. As a result, the secondary staged fuel jets, saturated with inert gases, do not produce elevated flame temperature zones when mixing and burning with the lean-fuel flame stream coming from the tile. For example, the design can be arranged to have adiabatic flame temperatures within 2400-2600° F. in secondary combustion zone 568, which are low enough not to generate thermal $NO_X$.

The embodiments of FIGS. 3-5 have all or substantially all of the required combustion air entrained or pushed through tubes 340 and delivered to combustion chamber 316. For example, the edges (or sides) of tubes 340 can be sealed to mounting plate 328 mounted to plenum 330 and base 320 of burner tile 314, ensuring no air can enter the combustion chamber from plenum 330 without traveling through tubes 340. In alternative embodiments, such as FIGS. 6 and 10 described below, minor amounts of the combustion air can be introduced in other areas of the combustion zone.

It is presently believed that the most benefit is derived by introduction of all the combustion air with the primary fuel within combustion chamber 316 or by introduction of a major portion of the combustion air into combustion chamber 316. However, in some embodiments, a minor portion of combustion air can be introduced outside of combustion chamber 316. "Minor amounts" or "minor portion" of combustion air generally refers to 25% or less of the stoichiometric air required to burn a unit of fuel. Typically, it will be less than 10% of the stoichiometric air required, can be 10% or less. In many embodiments, the minor amounts of combustion air will be in the range of from 5% to 25% of the stoichiometric air required to burn a unit of fuel. When all the combustion air is supplied into combustion chamber 316, those skilled in art will understand that this can allow for negligible amounts of combustion air to enter a combustion zone(s) from other sources, such as from ports for the stage injectors, ports of the ignition injectors, etc. Generally, to account for such negligible amounts of combustion air, this disclosure will refer to "substantially all" the combustion air being in the primary fuel-air mixture. In this case, "substantially all" refers to all the air besides these minor amounts that are less than 3%, less than 2%, less than 1% or less than 0.5% of the combustion air needed to burn the fuel introduced for ignition, as primary fuel and as staged fuel. Generally, "substantially all the air" can mean at least 97%, at least 98%, at least 99% or at least 99.5% of the air needed for combustion of the fuel, including the primary fuel, and optionally a second portion of fuel used for ignition and a third portion of the fuel used for stage fuel burning.

As will be realized from the above, the fuel and air mixture introduced into the combustion chamber by tubes 340 will not be stoichiometric; that is, the mixture will not have a ratio of fuel and oxidant ratio necessary for stoichiometric combustion of the primary fuel (the fuel introduced into combustion chamber 316). Rather, the primary fuel will be introduced as a lean fuel-air mixture. A "lean" fuel-air mixture indicates a fuel/oxidant mixture containing more oxidant than the amount required to completely combust the fuel. Generally, the embodiments described herein can be in the range of 50% to 110% excess air (about 7% to 11% excess oxygen).

Turning now to FIG. 6, an embodiment where minor amounts of combustion air may be introduced separately from the fuel-air mixing tubes is illustrated. FIG. 6 illustrates a furnace 500 at least partially containing a burner 610, which has a refractory tile 314 defining a combustion chamber 316 with tubes 340 and flame holders 350. Additionally, tubes 340 are fed fuel gas through primary fuel tips 344 and receive combustion air from a surrounding plenum 330. Furnace 500 has stage fuel tips 352 outside of and surrounding the tile 314. The aforementioned components are similar to those of FIG. 5 but may be in accordance with other embodiments illustrated herein. Thus, like the embodiment illustrated in FIG. 5, furnace 500 forms a primary combustion zone 566 and a secondary combustion zone 568.

However, burner 610 includes a bypass air tube 670, which introduces combustion air into furnace 500 so as to not impact the combustion occurring in primary combustion zone 566. As can be seen, bypass air tube 670 extends downstream even with primary combustion zone 566 or downstream from primary combustion zone 566 so that combustion air entering through bypass air tube 670 is introduced into secondary combustion zone 568 and not into primary combustion zone 566. In this manner, the fuel-air mixture introduced through tubes 340 can be significantly lean, i.e., with sufficient excess air for complete combustion of the primary fuel in the primary combustion zone when a relatively small amount of primary fuel is available for use in a primary combustion zone. Accordingly, additional combustion air—needed for combustion of the secondary fuel and to maintain excess oxygen in stack 504—is supplied through bypass air tube 670. Introduction of combustion air through bypass air tube 670 is controlled by actuator 672. For example, a computer processing system can control actuator 672 to reduce or increase combustion air introduced through the bypass air tube 670 as necessary to control the adiabatic flame temperature (AFT) within the primary combustion zone which will enable further control of $NO_X$ and CO levels from the primary and secondary combustion zones, as further discussed below. This is especially useful in cases where the primary and secondary fuels are different and the quantity of fuel available for use in the primary combustion zone is limited to below the desired amount needed to achieve the proper AFT with all of the combustion air being introduced into the primary combustion zone.

Alternatively or in addition to the above, adjustments to the combustion air introduced through the tubes 340 and to the combustion air introduced through bypass air tube 670 can be used to change the distribution of air within burner 610. For example, the amount of excess air coming from the primary combustion zone can be increased or decreased with a corresponding decrease or increasing in the excess air coming through bypass air tube 670.

Figure 7:
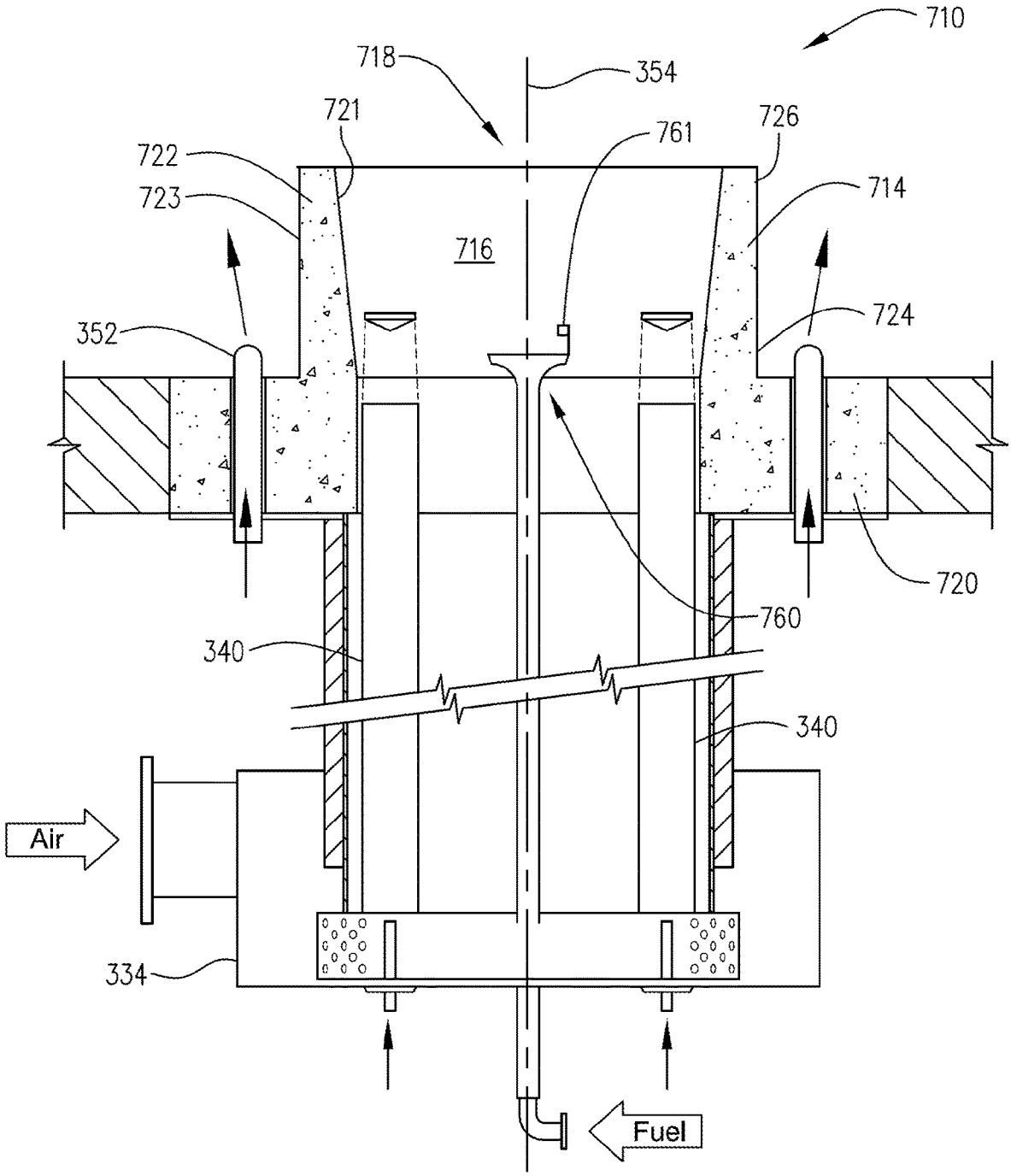
FIG. 7 is a schematic illustration of a furnace using a burner system in accordance with another embodiment.
Figure 7:
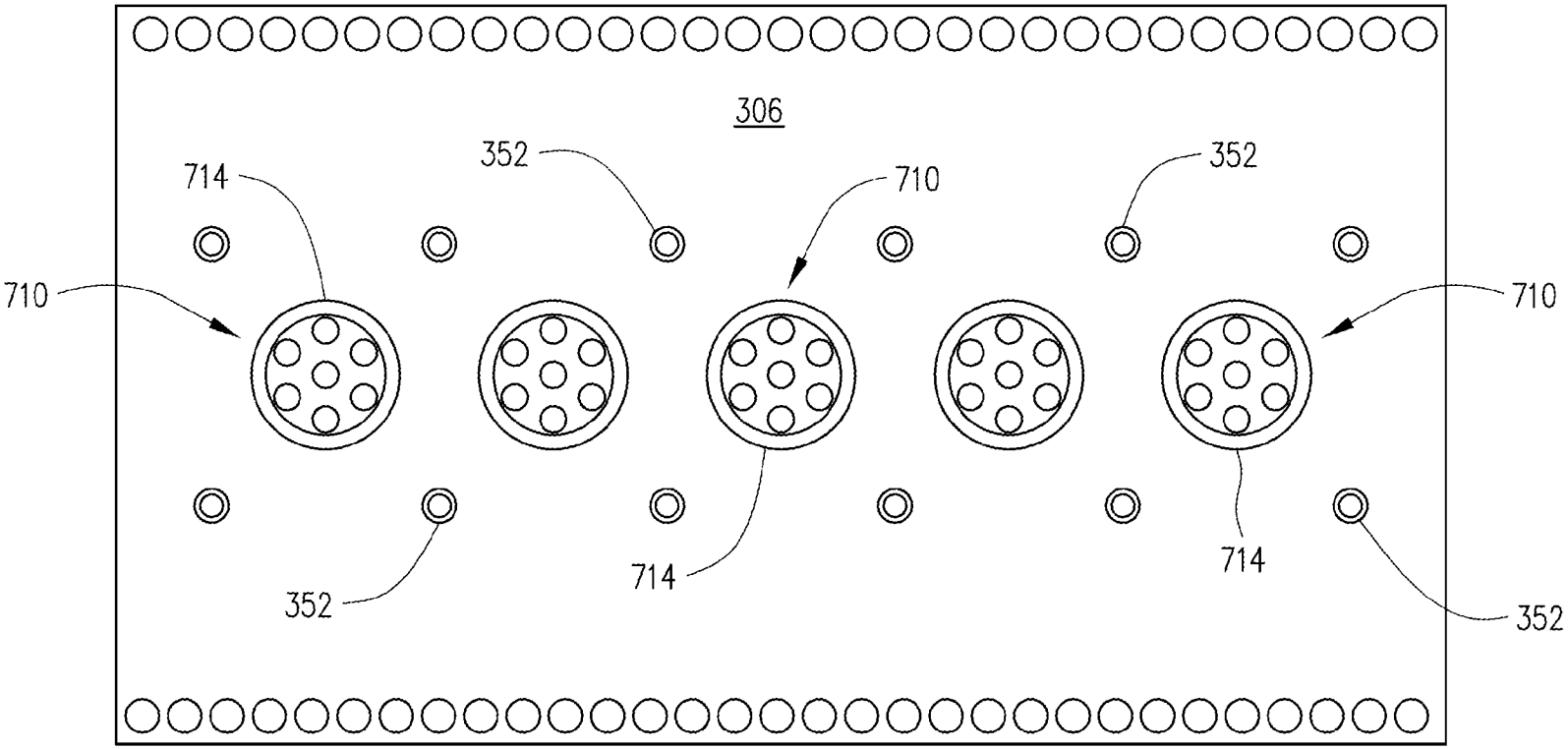

Turning now to FIGS. 7-14, certain features of the above embodiments and further embodiments of the current disclosure will now be discussed. Specifically, FIG. 7 illustrates a further burner embodiment. Burner 710 of FIG. 7 has many components similar to FIGS. 3-5; accordingly, like numbers indicate like components. However, whereas FIGS. 3-5 use a cylinder shaped burner tile (inside and/or outside), embodiments of this disclosure can also utilize burner tiles having a convergent or divergent interior surface defining the burner chamber. For example, FIG. 7 illustrates a burner tile 714 having a tile wall 722 with a cylindrical outer surface 723 and a divergent interior surface 721. Thus, tile wall 722 is thicker at first end 724 than at second end 726. Thus, divergent interior surface 721 defines a conical-shaped combustion chamber 716 as opposed to the cylindrical-shaped combustion chamber of FIGS. 3-5. This divergent angle for interior surface 721 allows the flames and recirculating vortexes to be expanded freely toward tile exit aperture or outlet 718, thus preventing possible pressure fluctuations inside the tile combustion chamber especially at higher heat releases.

Staged fuel tips 352 shown in FIG. 7 discharge staged fuel jets outwards from the outer surface 723 of burner tile 714. The tips can be positioned at a further distance from the burner and can even be placed in the furnace wall as opposed to base 720 of tile 714. Such an arrangement is illustrated in FIG. 8, wherein furnace wall 306 has multiple burners 710 with stage fuel tips 352 being positioned in furnace wall 306 remotely from the burner tiles 714. The positioning of stage fuel tips 352 in relation to the burner tile is determined to achieve maximum possible staged fuel jets saturation by inert furnace flue gases prior to mixing with excessive air coming from primary combustion zone. Thus, staged fuel tips 352 can discharge fuel jets outwards from the outer surface 723, discharge the fuel jets in line with outer surface 723 or even toward outer surface 723 of burner tile 714 in order to help achieve such saturation.

Figure 9:
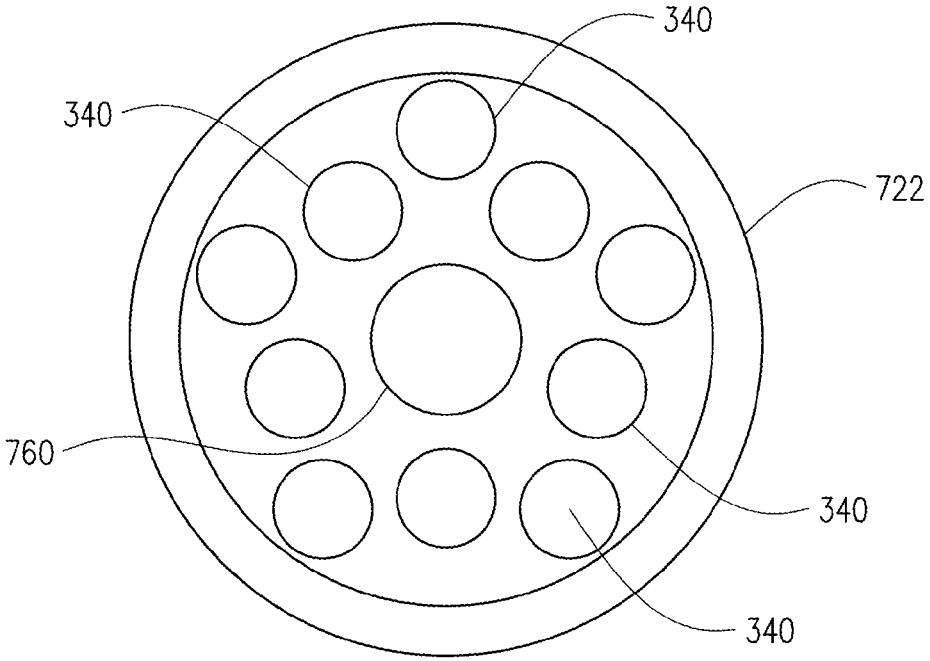
FIG. 9 is a schematic top view of a burner system, which illustrates one embodiment of tube placement within the burner tile.
Figure 10:
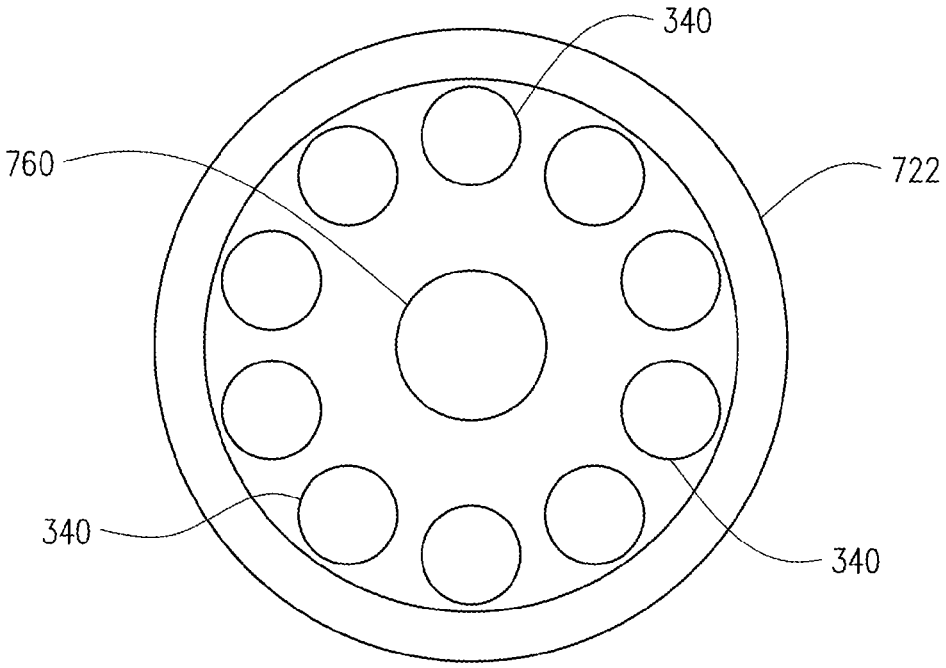
FIG. 10 is a schematic top view of a burner system, which illustrates another embodiment of tube placement within the burner tile.

As previously described, the number, diameter, cross sectional shape of tubes 340 may vary significantly from one tile size to another. FIG. 9 shows ten tubes 340 positioned inside tile wall 722 in two rows; each having a different radius from center or center ignition unit 760. FIG. 10 shows ten tubes positioned in one row around the center or center ignition unit 760. While shown in relation to the embodiment of FIG. 7, those skilled in the art will understand the placement principles apply generally to most embodiments under this disclosure, including the other specific embodiments disclosed herein.

Figure 11:
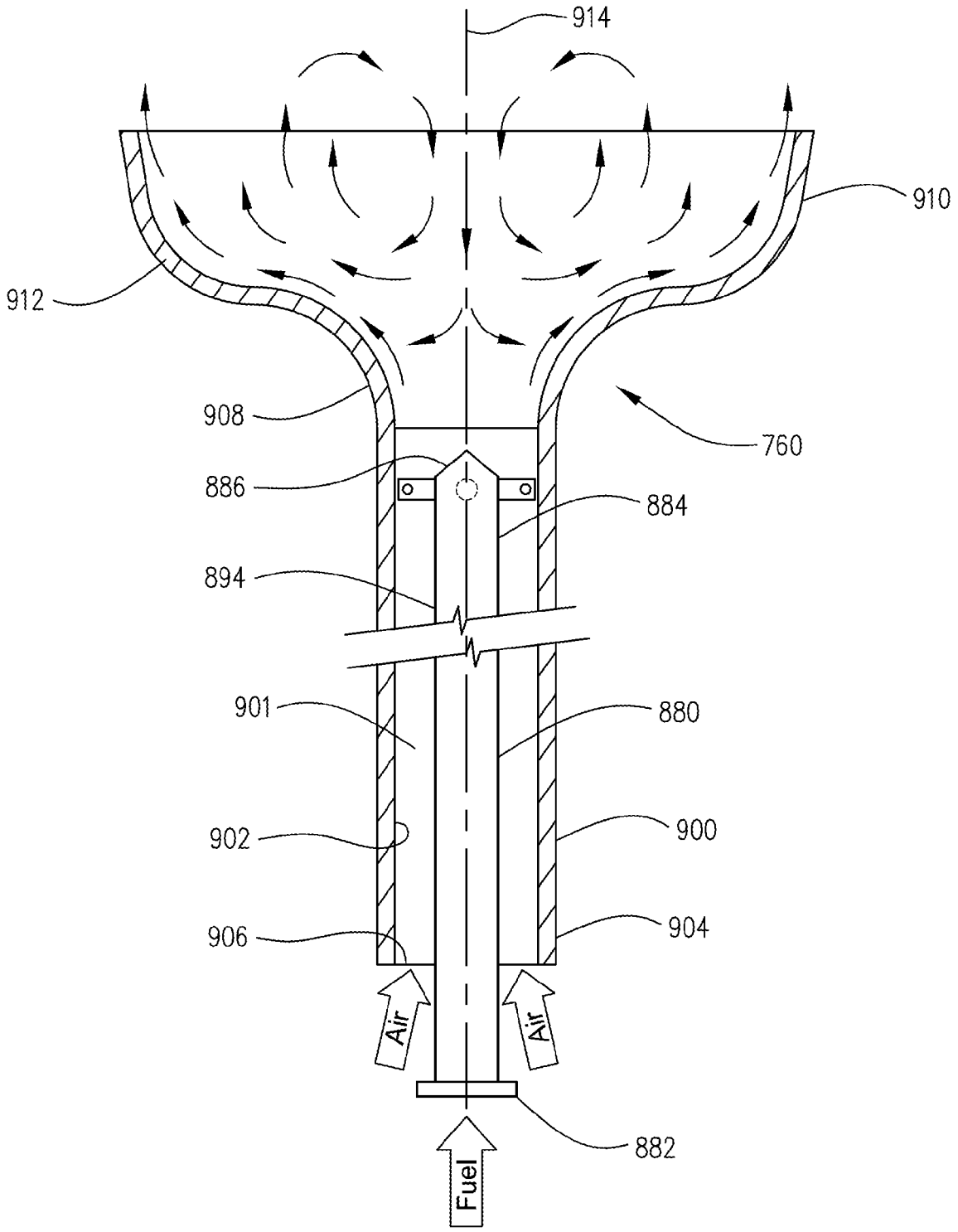
FIG. 11 is a schematic illustration of one embodiment of an ignition unit suitable for use with burner systems in accordance with this disclosure.

While igniters are known in the art, other embodiments provide for novel ignition units, which can be used as ignition units for the above embodiments. FIG. 7 shows one such ignition unit 760 in relation to the burner tile 714. FIG. 11 illustrates ignition unit 760 in more detail.

Ignition unit 760 comprises a fuel supply lance 880 positioned concentrically in a riser tube 900. A first end 882 of lance 880 is in fluid flow communication with a source of fuel gas (not shown in FIG. 11). A second end 884 of lance 880 terminates within riser tube 900 in a fuel discharge nozzle 886 such that fuel flowing through lance 880 is discharged in a swirling pattern through fuel jets. In other words, the fuel is discharged so as to move circumferentially and longitudinally within riser tube 900.

Figure 12:
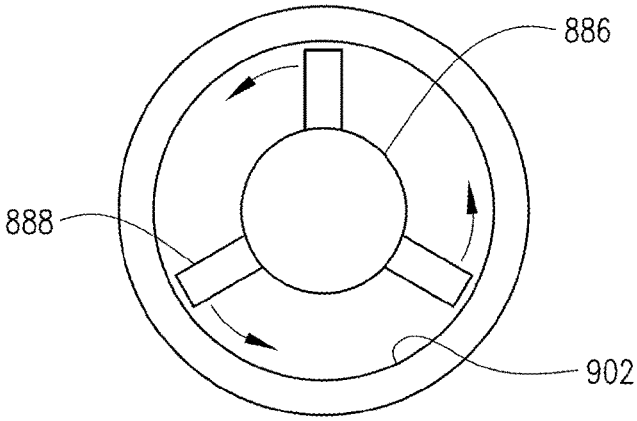
FIG. 12 is a schematic illustration of one embodiment of a suitable nozzle for use in the ignition unit of FIG. 11.
Figure 13:
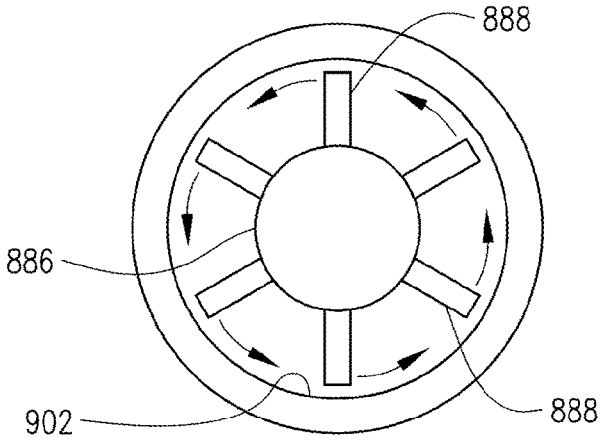
FIG. 13 is a schematic illustration of a second embodiment of a suitable nozzle for use in the ignition unit of FIG. 11.
Figure 14:
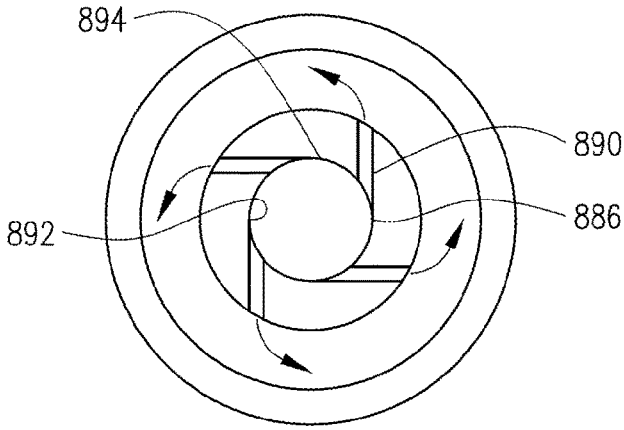
FIG. 14 is a schematic illustration of a third embodiment of a suitable nozzle for use in the ignition unit of FIG. 11.

Some suitable structures for nozzle 886 are illustrated in FIGS. 12, 13 and 14. As illustrated in FIG. 12 and FIG. 14, nozzle 886 can have one or more discharge arms 888 serving as fuel jets. Discharge arms 888 discharge fuel tangentially to the inner surface 902 of riser tube 900, which is tangentially with respect to fuel supply lance 880. Typically, there will be a plurality of discharge arms 888 spaced equally about the circumference of lance 880. FIG. 12 shows three discharge arms 888, and FIG. 13 shows six discharge arms 888. As illustrated in FIG. 14, a swirling pattern can also be achieved by one or more passages in lance 880, which serve as fuel jets. Passages 890 extend through lance 880 from the inner surface 892 to the outer surface 894. Passages 890 extend tangentially from inner surface 892. Typically, discharge arms 888 or passages 890, whichever is used, are angled towards second end 908 of riser tube 900; thus, fuel is discharged tangentially to the center of riser tube 900 and slightly forward (towards second end 908). Typically, the angle forward will be about 5 degrees to about 25 degrees.

Riser tube 900 has a first end 904 which can be closed (not illustrated) or can be in fluid flow communication with a supply of combustion air (as illustrated in FIG. 11). Thus, first end 904 can terminate in an aperture 906, which is located at or near the base of plenum 334, either inside plenum or outside the plenum (as shown). Typically, aperture 906 will be outside plenum especially where there is a forced air supply into plenum.

A swirler cup 910 is connected to second end 908 of riser tube 900. Swirler cup 910 is positioned within the burner tile and can be positioned along the central burner axis 354 of burner 710. Additionally, swirler cup 910 will typically be in the center of tubes 340 as shown in FIGS. 7-10. Swirler cup 910 is configured to promote the swirling and forward movement of fuel discharged from nozzle 886. As illustrated, swirler cup 910 comprises a diverging curved wall 912.

In operation, the high-pressure raw fuel gas is directed through the lance 880 toward the attached nozzle 886. Then the fuel jets (such as discharge arms 888 or passages 890) discharge fuel tangentially to the center of riser tube 900 and slightly forward (5-25 degrees). Accordingly, the angle of discharge is a compound angle, which allows the one or more fuel jets to swirl and move forward inside the riser tube 900. That swirling/spiral movement continues along the inner surface of swirler cup 910, resulting in forming the swirling flame inside swirler cup 910 and further on coming out of swirler cup 910. A direct electrical spark provided by an igniter 761 (shown schematically in FIG. 7), as known in the art, may be used to ignite the flame initially. The swirler flame is very stable due to forming the powerful backflow rotating vortex inside swirler cup 910 along centerline 914. This vortex is permanently reigniting the swirling stream and sustains the total stability of ignition flame.

The swirler flame may be organized with or without a slight airflow coming toward the swirling fuel jets through riser tube 900. FIG. 11 shows that some air may come in through the annulus passage 901 formed between inner surface 902 of tube 900 and outer surface 894 of lance 880. The air flow may be optimized to minimize $NO_X$ emissions.

As indicated above, swirler cup 910 can be positioned along the central burner axis 354 of burner 710 and in the center of tubes 340, as shown in FIGS. 7-10. In this position, the swirler flame can contact all the primary fuel-air streams coming out from tubes 340 and ignite them instantly. However, it is within the scope of this disclosure for the ignition unit 760 and tubes 340 to be positioned differently depending of tile geometry, number and geometry of tubes and other factors.

Figure 15:
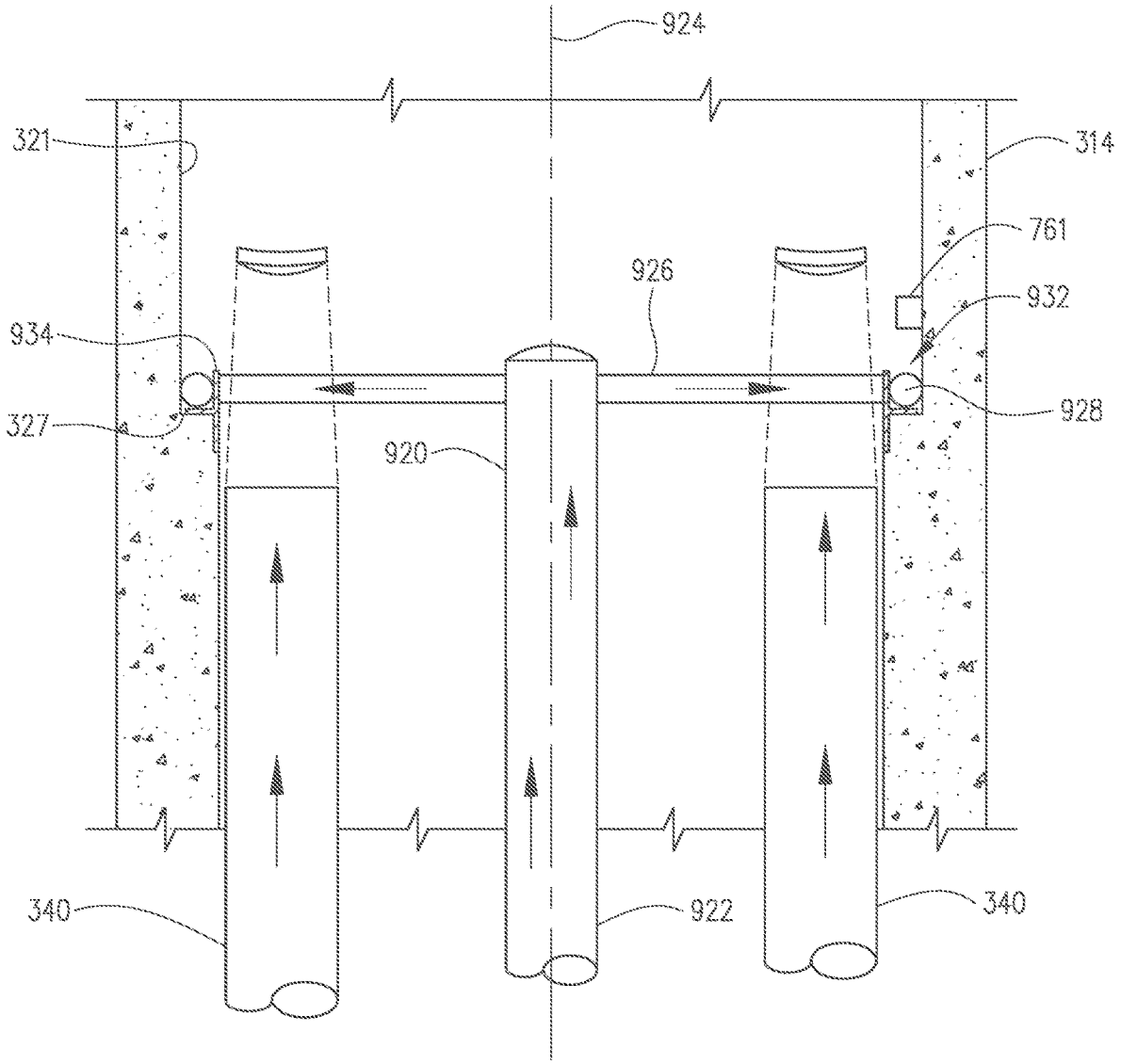
FIG. 15 is a schematic illustration of another embodiment of an ignition unit suitable for use with burner systems in accordance with this disclosure.
Figure 15:
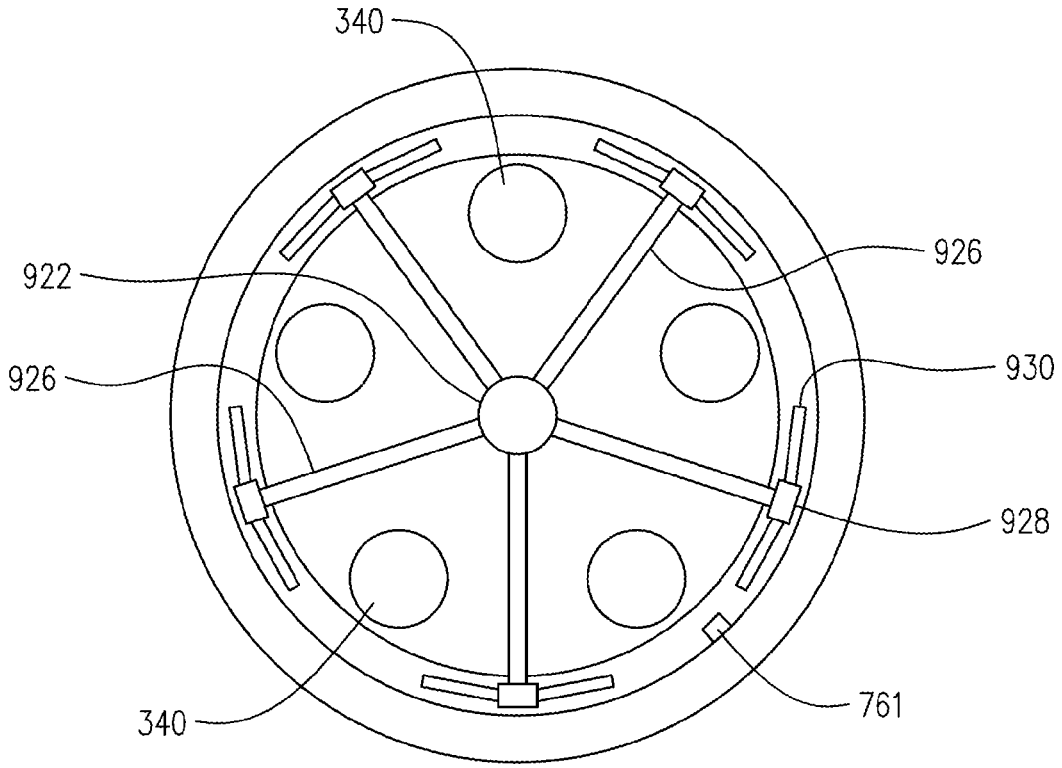

FIGS. 15-16 show another embodiment of possible ignition unit. This ignition unit 920 has a central pipe or tube 922 extending along longitudinal centerline 924 of a burner tile, such as 314 of FIG. 3. Pipe 922 has at least one radially extending legs 926. Typically, pipe 922 will split into a plurality of radially extending legs (five as shown in FIG. 16). Each leg 926 ends in a nozzle 928, which has one or more ports 930 to discharge fuel jets along the inner circumference of interior surface 321 of burner tile 314. Fuel or air mixture is introduced through central pipe 922, through legs 926 and then through nozzles 928 onto the interior surface 321 of the tile wall 322, such that the fuel or fuel-air mixture moves circumferentially along interior surface 321. Where only fuel is provided through the nozzles 928, or where insufficient air for stoichiometric burning of the fuel is supplied through nozzles 928, air from the fuel air mixture passing through tubes 340 is used to burn the fuel from the ignition unit.

Generally, the discharge through nozzles 928 will be along ledge 327, if used. Thus, the flames formed from the ignited fuel jets can be kept inside an annulus cavity 932 formed by the tile ledge 327 and by a ring 934 installed on that ledge. A direct electrical spark device (igniter 761), as known in the art, may be used to ignite the fuel discharged from one of the nozzles 928. As soon as flame from one nozzle is established, the flames propagate along circumference in both directions very reliably.

In the above embodiments, the flow of the primary fuel and secondary fuel can be controlled by adjusting the flow rate of fuel introduced through primary fuel tips 344 and secondary fuel tips 352. Typically, the adjustment of the flow is inversely related, i.e., if the primary fuel flow is increased, the secondary is decreased, and vice versa. Additionally, combustion air introduced can be controlled in natural draft burners by adjusting the plenum so as to allow more or less air to pass into the plenum, such as by changing the aperture size where air is introduced. Combustion air can be controlled in forced air supply burners by changing the air forced into the plenum, such as by changing fan or blower speeds. In some embodiments, a computer processing system can be configured to control fuel flow and the introduction of air into the plenum, as further discussed below.

Also, air chamber 336 of plenum 330 can be void (besides air). Thus, the air in the upper portion of air chamber 336 is warmed at the end near mounting plate 328 and the warmed air gasses can travel down from the end near combustion chamber on the outside of tubes 340, preheating the primary combustion air in tubes 340 like a recuperator. Doing so has been discovered to further improve the CO emissions performance by increasing the fuel-air mixture temperature before it exits tubes 340 just enough to mimic additional residence time within the combustion chamber. In another example, tubes 340 can mount directly to the combustion chamber mounting plate and are not surrounded by a plenum.

As illustrated in the figures, the combustion chamber's design can include a calculated volume, a ledge 327, ignition and pressure relief/recirculation windows (ports 425 of FIG. 4), tubes 340 (generally mixing tubes) that are arranged inside the combustion chamber, and flame holders 350. The components described above are uniquely arranged with respect to each other to ensure the primary flame anchors at the desired location within the combustion chamber. Any number of combustion anchoring devices 350 may be utilized, and they serve to stabilize the primary flame inside the tile's combustion chamber.

The result is that the apparatus can operate at excess air levels close to or even above the upper flammability limits of the fuel at room temperature. These conditions depress thermal and prompt oxides of nitrogen formation from the flame. The carbon monoxide emission levels are depressed because the tile's combustion chamber design elevates the local environment temperature within the tile combustion chamber. It is currently believed this makes the CO emissions level of the primary flame perform like that of a typical apparatus installed in a hot application (hot furnace application) where the CO emissions level are naturally reduced due to fast oxidation rates to CO2.

In accordance with the above discussion, the general method of operation of the embodiments above comprises first establishing a furnace draft to induce combustion airflow through the tubes 340 in an amount required for ignition. The flow of raw ignition fuel from an ignition unit (for example ignition unit 760 or ignition unit 920) is passed into the combustion chamber of the burner tile and ignited using an igniter. In some embodiments, the flow of ignition fuel can be directed along the inner tile ledge of the tile such as by ignition unit 920 or due to a Coanda effect created by the shape of the side of the channels (using the Coanda design of U.S. Pat. No. 7,878,798).

After the ignition flames are established, the primary fuel tips 344 inject fuel into the tubes 340 such that, using an entrainment effect, the fuel is thoroughly mixed with combustion air and this mixture is ignited by the ignition flames already present in the combustion chamber by the ignition unit. Thus, the primary flames are stabilized on flame holders 350 and on the inner step ledge 327 of the tile, if used. Stability is maintained through hot, re-igniting vortices just downstream of the flame holders and the recirculation zone formed by the ledge of the tile. Part of the air-fuel mixture is deflected by the flame holders to the tile's combustion chamber inner surface. This mixture scrubs and burns on the surface, making the surface glow and acts as an additional, reliable source of flame stabilization inside the tile's combustion chamber.

To form the lowest possible $NO_X$ emissions, depression of the thermal and prompt oxides of nitrogen formation is necessary. Preferably, the air/fuel ratio at the mixing tube outlet is set as high as possible without compromising flame stability, as close to the upper flammability limit as possible. For example, the excess air levels can be controlled to 50-110% (lean mixture, lean flame) excess air levels. The fuel preferably is mixed with air while traveling through tubes 340 as thoroughly as possible; uniformity of the air/fuel mixture is critical to the performance of the apparatus.

As discussed previously, in other embodiments, the fuel and air may be provided separately to the apparatus combustion chamber so long that they mix quickly to the appropriate level before igniting.

Anchoring the flame within the apparatus combustion chamber allows an average and uniform adiabatic flame temperature of 2400-2600° F. Sequentially, the apparatus combustion chamber volume temperature is also around 2400-2600° F., regardless of the surrounding environment temperature (the temperature of the furnace chamber outside of the burner).

To increase the heat release from normal to maximum heat release, embodiments use staged fuel tips 352. Gradually discharging the staged fuel allows increasing of the heat release from normal to maximum heat release by consuming the excess oxygen from the primary flame. For example, if the burner operates at 5 MMBtu/hr heat release, having only primary and ignition fuel on, and mixture is burning with a flame stabilized inside the tile, the oxygen concentration in the furnace stack is set between 7-11% (vol dry). At this point, the blower combustion-airflow rate is fixed and staged fuel flow can be gradually increased to consume excess oxygen and achieve a heat release rate of 8 MMBtu/hr. The stack oxygen content will be reduced to 2-3% (vol dry) which is a common requirement for heater operation at maximum heat release for getting optimal fuel efficiency.

Once this condition is achieved, both the primary fuel, staged fuel, and air supply can be varied proportionally to maintain 2-3% (volume dry) excess O2 in the furnace stack, so long that the environment (heater flue gas bridgewall) temperature does not fall below a certain lower limit where the staged fuel will start to produce additional CO emissions. Before this condition occurs (typically at or below furnace temperatures of ~1350° F.), the staged fuel can then be turned off, and low CO and $NO_X$ emissions can be maintained by operating the primary flame only, which anchors within the apparatus combustion chamber.

In many applications, the fuel composition can change during operation of the burner. Due to the changing composition of the fuel, there can be variations in the $NO_X$ and CO emissions. Additionally, variations that drive variations in $NO_X$ and CO emissions are combustion-air conditions (such as relative humidity in the air), and furnace flue-gas temperatures surrounding the burner flames. All these system conditions can cause large variations in $NO_X$ and CO emissions. Accordingly, this disclosure also concerns systems and methods for adjusting the burner so as to maintain desirable $NO_X$ and CO emissions.

Generally, the system and method will monitor fuel composition so as to detect changes in fuel composition. The determination can be at intermittent intervals or at periodic intervals or can be determined continuously. The system and process also monitors the flow rate of primary fuel into the system and the flow rate of secondary fuel into the system. Additionally, the system determines the adiabatic flame temperature (AFT) at various positions in the furnace or burner. Typically, the positions will include at least the primary combustion zone and the secondary combustion zone. These AFT values can be calculated from the fuel composition and the amount of air introduced into the burner and/or furnace, in which case the combustion-air flow into the burner/furnace is monitored. Alternatively, the actual flame temperatures can be monitored for each position by sensors.

After the AFT values are determined, the air quantity required to minimize $NO_X$ is determined. The air quantity can be determined based on the AFT values and an experimental curve, wherein the experimental curve is derived from experimental data on excess air quantity (the amount of air in excess of the stoichiometric airflow required to accomplish the chemical reaction of combustion) and adiabatic flame temperature (AFT) for a plurality of fuel compositions.

Based on the air quantity determination, at least one of the flow rate of the primary fuel, the flow rate of secondary fuel, the amount of air introduced into the burner and/or furnace, and the distribution of air introduced into the burner and/or furnace is adjusted. As will be appreciated, if the fuel flow rate is adjusted, the adjusting step is typically at least to both the flow rate of the primary fuel and the flow rate of the secondary fuel. Additionally, the flow rate of the primary fuel and the flow rate of the secondary fuel are typically adjusted simultaneously. For example, as the flow rate of the primary fuel is increased, the flow rate of the secondary fuel is simultaneously decreased.

Figure 17:
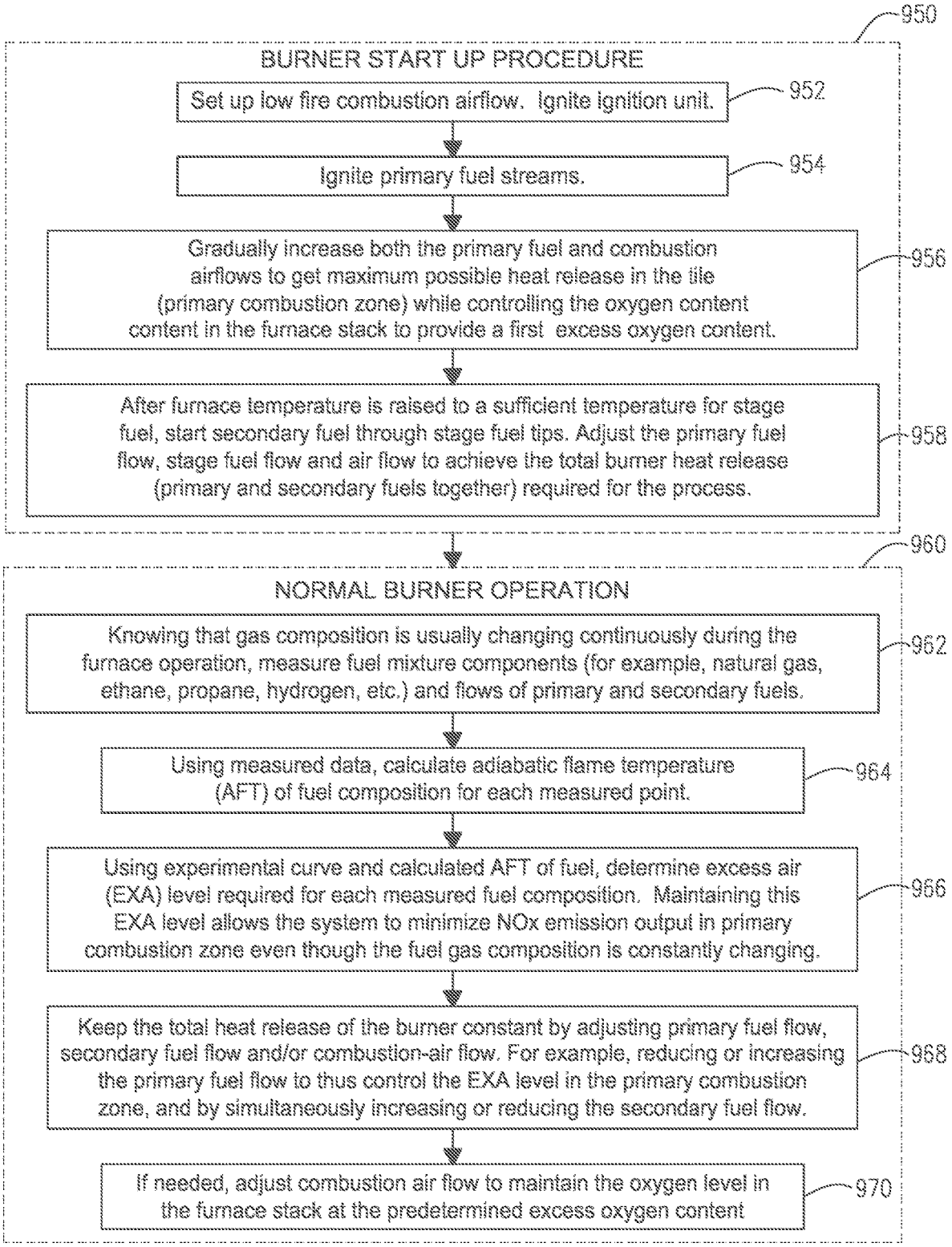
FIG. 17 is a flow diagram of a process for regulating $NO_X$ and CO emissions in accordance with the current disclosure.
Figure 14:
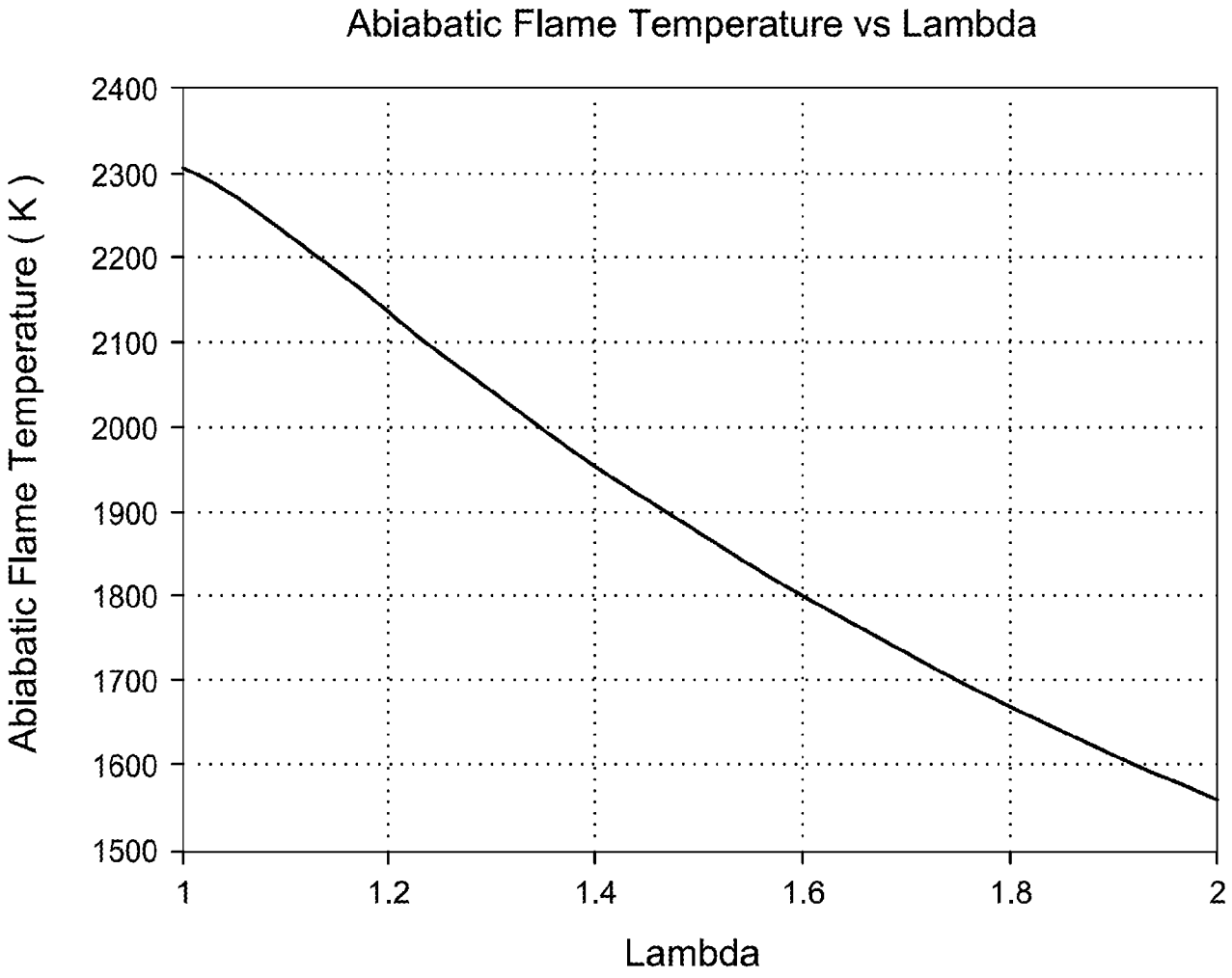
Figure 15:
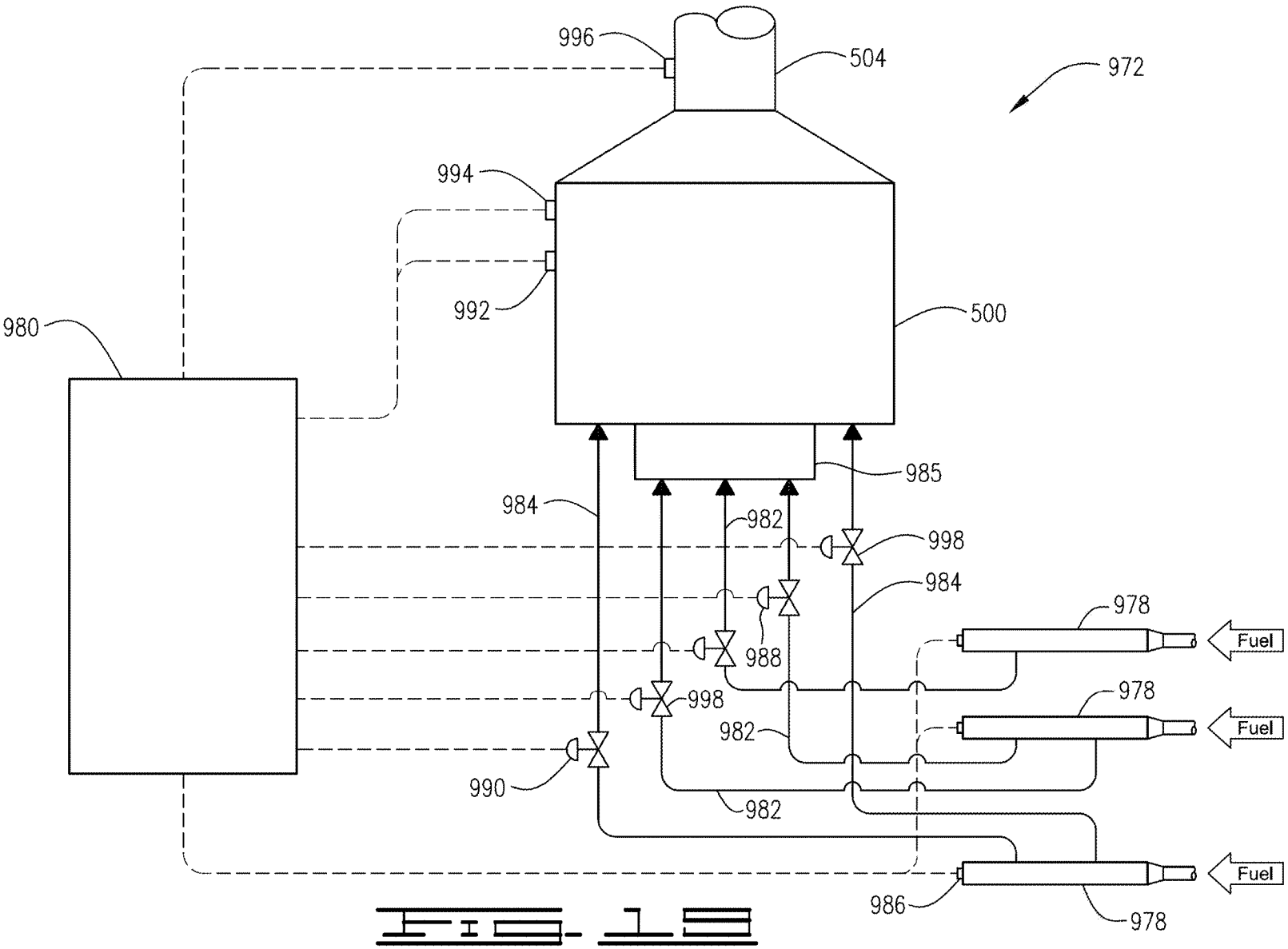

The method and system can be further understood with reference to FIG. 17. Where a burner start-up procedure 950 followed by a normal burner operation is outlined in various stages.

For a furnace which has been inactive, the Burner Start-Up Procedure 950 is instigated. First in step 952, the combustion-air flow is established by initiating of the blower and the ignition fuel introduced through the ignition unit is ignited, for example by using a direct spark igniter. The ignition unit can be any suitable design such as a swirler-type ignition unit or tile-ledge ignition unit.

As soon as ignition flame is established for the ignition unit, step 954 is instigated. In step 954, primary fuel and combustion-air mixture is started through the primary fuel injectors. The mixture introduced into the burner through the primary fuel injectors is then ignited by the flame of the ignition units.

After primary flames are established, step 956 proceeds with increasing the primary fuel flow to get maximum heat release in the primary combustion zone. The combustion-air flow is increased as well, to maintain the oxygen level in the heater stack at a first excess oxygen level and to maintain an exact excess air/oxygen level within the primary combustion zone which correlates to a specific combustion temperature for emissions. Typically, this first excess oxygen level will be sufficient to allow the primary fuel to burn at an oxygen level calculated to minimize $NO_X$ and CO emissions. For example, the primary fuel might be introduced with sufficient oxygen to burn the primary fuel in the primary combustion zone and maintain an oxygen level in the stack of 7-11% (vol. dry) (first excess oxygen level) in step 956. This can be calculated to burn the secondary fuel in the secondary combustion zone when the secondary fuel flow is started in step 958 and leave remaining 2-3% oxygen level in the stack during Normal Burner Operation 960. The 2-3% oxygen level is a typical standard applied as the normal excess oxygen level in fired equipment in order to maximize fuel efficiency. As indicated above, "stack" or "furnaces stack" as used herein includes any point downstream of the furnace combustion zones where emission and excess oxygen content of the flue gases can be measured. Typically, this point will be in the stack or exit flue of the radiant section of the furnace but in some embodiments could be a zone within the furnace but outside of the combustion zones, or could be a zone just downstream from the exit flue of the furnace.

Next during Burner Start-Up Procedure 950, step 958 is instigated wherein staged fuel or secondary fuel is discharged from the staged fuel tips into the furnace. To increase the heat release from primary combustion zone and thus maximum total heat release, the furnace is equipped with staged fuel tips to discharge secondary fuel jets. The discharge of the staged fuel allows the increase of heat released from the primary fuel to maximize the total heat released by consuming the excess oxygen from the primary flame.

Accordingly, after the furnace temperature is raised by the combustion of primary fuel to a temperature sufficient for stage fuel, the secondary fuel flow is started through the stage fuel tips. Once secondary fuel flow is started, the primary fuel flow, stage fuel flow and/or combustion-air flow can be adjusted to achieve the total burner heat release (primary and secondary fuels together) required for the process.

For example, if the burner operates at 5 MMBtu/hr heat release, having only primary fuel introduction (primary injectors and ignition unit), and the mixture is burning with the flame stabilized inside the tile, the oxygen concentration in the furnace stack can be set between 7-11% (vol. dry). At this point, the blower combustion-air flow rate can be fixed, and secondary (staged) fuel flow can be gradually increased to consume excess oxygen and achieve a heat release rate of 8 MMBtu/hr. The stack oxygen content will be reduced to 2-3% (vol. dry), for example, which is a common requirement for heater operation at maximum heat release.

Alternatively, once the furnace temperature is sufficient for staged fuel firing, the staged fuel introduction can be initiated and the primary fuel and air flow can be decreased while increasing the secondary fuel flow to achieve the desired oxygen content in the furnace stack—for example 2-3% (vol. dry) oxygen—without having to fire significantly more total fuel (primary and secondary fuel combined).

Once the stage fuel is started and the predetermined oxygen level in the stack has been achieved, the furnace is in normal burner operation. In accordance with the current process, during Normal Burner Operation 960, both the primary and secondary fuel flows, and the air supply can be varied proportionally to maintain the predetermined excess oxygen in the furnace stack, in the example above 2-3% (volume dry) excess oxygen in the furnace stack. Typically, only the primary and secondary fuel flows will be varied. Also, so long as the environment (heater flue-gas bridge-wall) temperature does not fall below a predetermined lower limit where the staged fuel will start to produce additional CO emissions, the furnace will continue to operate with primary and secondary fuel and low excess stack oxygen. However, if the temperature approaches the lower limit (for example, at or below furnace temperatures of ~1350° F.), the staged fuel can be turned off, and low CO emissions can be maintained by operating only the primary fuel flame attached to flame holders within the burner combustion chamber.

The method provides for control of the normal operation of the furnace needs in response to fuel (primary and secondary) composition changes as well as other system changes, such as humidity levels. For example during operation, the fuel can intermittently, periodically or continuously change in the ratio of mixed gases making up the fuel. For example, the fuel generally comprises a combination of natural gas, ethane, propane and hydrogen and additionally other heavy hydrocarbons. If the ratio of these components changes, then the adiabatic flame temperature of combustion changes. For example, if the proportion of hydrogen increases, the fuel will burn hotter, and if the proportion of hydrogen decreases, the fuel will burn cooler.

During Normal Burner Operation phase 960 of the process, the fuel mixture components are determined during step 962. Additionally, during step 962, the flows of primary and secondary fuels into the furnace are measured and tracked. Typically, the flows of fuel through the primary fuel tips, through the stage fuel tips and through the ignition unit (if in use) will be measured. Additionally, if there are other fuel tips in use in the systems, the flow of fuel through these fuel tips can also be tracked and measured.

Next in step 964, the measured data is used to calculate adiabatic flame temperature (AFT) of the fuel composition for each measured point. In step 966, an experimental data curve and calculated AFT of the fuel is used to determine the excess air (EXA) level required for each measured fuel composition. Maintaining this EXA level allows the system to minimize $NO_X$ emission output in primary combustion zone even though the fuel gas composition is intermittently, constantly or periodically changing.

The experimental data curve is an EXA (Lambda) versus AFT curve. An example of the excess air versus AFT is illustrated as FIG. 18. Lambda is the ratio of total airflow coming through the burner to stoichiometric airflow. Excess air (EXA) can be expressed as a percentage above stoichiometric flow, for example, is if λ is 1.0, then EXA is 0%; if λ is 1.75, then EXA is 75%; if λ 2.0 then EXA is 100%; and if λ is 3.0, then EXA is 200%. The AFT numbers are calculated based on fuel gases composition and combustion air properties. The EXA is determined experimentally for each fuel composition to target the minimal possible $NO_X$ emission output. Also, experimental data can be used to determine the lowest possible AFT per fuel composition to minimize $NO_X$ emissions while maintaining an AFT high enough such that the combustion process can be self-sustaining (stable without an additional constant ignition source present).

The method can include continuous sampling and measurement of changing fuel composition gases, followed by calculation of adiabatic flame temperature (AFT) (or direct measuring of flame temperature) with further determination of excess air EXA required to operate the primary part of the burner for getting minimum $NO_X$ emission output.

In alternative embodiments, one or more sensors measure the oxygen content in the stack, $NO_X$ and/or CO levels in the stack. These measured values can then be used instead of the EXA (Lambda) v. AFT curve to determine the adjustments to be made to the system in the following steps.

Due to changes in operating conditions, such as continuous, intermittent or periodic changing of fuel composition during the heater operation—and thus variation of AFT and ultimately $NO_X$ and CO emissions—the next step 968 is to adjust primary fuel flow, secondary fuel flow and/or combustion-air flow so as to hold constant the total heat released by fuel combustion in the furnace. Thus, the system allows for the fuel gas distribution and/or combustion air within the furnace to be dynamically changing per fired zone in such a way that total fuel flow or heat release in the furnace (or in the heater) is not changing (constant).

For example, if the fuel composition shifts to a higher flame temperature (such as caused by a higher hydrogen content), then with the required combustion-air flow within the primary combustion zone fixed, the primary fuel flow can be decreased while simultaneously increasing the secondary fuel flow. Thus, the primary and secondary fuel flows can be adjusted simultaneously in such a way that a total fuel flow to the burner (or to the heater/furnace) and the total heat released by fuel combustion does not change; that is, they are constant. Thus, having combustion airflow fixed, decreasing the primary fuel flow and simultaneously increasing secondary fuel flow, leads to EXA flow increase in the primary zone of the burner, which is exactly what is required for hotter burning fuels, such as higher hydrogen content fuels, to obtain $NO_X$ and CO emissions that do not vary based on the fuel composition.

When the fuel flows are changed, measured oxygen content in the heater stack generally will need to be kept in a predetermined range, for example, 1-4% (vol. dry), or 2-3% (vol. dry), or 2.5-3% (vol. dry) based on the total gaseous content in the stack. Thus, changing primary and secondary fuel flows may require, in the final step 970, adjustment to the total combustion air in order to make sure that oxygen content in stack is always within the predetermined range.

As will be appreciated, the Normal Burner Operation steps 960 are an ongoing process with fuel composition being constantly monitored in step 962, and with steps 964 to 970 being performed whenever there is a significant change in fuel composition; i.e., whenever the change in fuel composition is likely to result in at least a 5% change in $NO_X$ emissions, typically at least a 10% change in $NO_X$ emissions, and more typically at least a 15% change in $NO_X$ emissions. However, this change can vary depending on the emission targets and established margin for the furnace. Conventional furnaces can vary by 25% to 50% in $NO_X$ emissions in a day; however, furnaces using the current systems and methods can be reduced to less than 5% variations in $NO_X$ emissions in a day.

Also, as will be appreciated, an adjustment of fuels may be reversed from the above description, i.e., a change in fuel composition may require increasing the primary fuel flow and simultaneously decreasing the secondary fuel flow. For example, the primary fuel flow might need to be increased and the secondary fuel flow decreased when the fuel changes to a composition which burns cooler than the previous composition, such as when the fuel composition changes to have less hydrogen content. Additionally, such a change in fuel flows can also require either increasing or decreasing the total combustion air so as to maintain the oxygen in the stack in a predetermined range.

Referring now to FIG. 19, a schematic diagram of a system 972 for carrying out the above-described process is illustrated. System 972 includes a furnace 500 having a stack 504, a plurality of fuel distributors 978 and a computer processing system (CPS) 980. Further, furnace 500 includes a burner typically having the components for igniting and burning the fuel within the furnace such as a refractory tile, fuel tips, plenum, etc., which can be in accordance with the above described burner embodiments. In FIG. 19, only plenum 985 of the burner is visible.

Fuel distributors 978 provide primary fuel (both for the primary fuel injectors and ignition unit) through fuel lines 982 and secondary fuel through fuel lines 984. Generally, there will be separate fuel distributors for the primary fuel and secondary fuel so that the fuel flow rates of these can be controlled separately. Also, often primary fuel injectors and the ignition unit will have separate distributors so fuel rate to these can be controlled separately. The fuel lines 982 and/or 984 pass through plenum 985 (forming part of the burner, which is at least partly contained within furnace 500), where combustion air from the plenum can be mixed with fuel passing through the fuel lines, such as by use of mixing tubes. Typically, the fuel lines 982 for the primary injectors will introduce a fuel-air mixture.

One or more sensors 986 take measurements of the fuel and transmit the resulting data to CPS 980 so as to determine the composition of the primary fuel and secondary fuel. One or more sensors 988 and 990 measure the flow rates of the primary and secondary fuel and transmits the resulting data to CPS 980. In some embodiments, system 972 uses sensors 992 and 994 to measure the adiabatic flame temperatures at various positions including the primary combustion zone and secondary combustion zones within furnace 500. In other embodiments, the adiabatic flame temperatures are determined by CPS 980 based on the fuel composition and preloaded experimental data. Additionally, system 972 can utilize sensors 996 to measure the $NO_X$, CO and/or excess air quantity in the furnace stack 504. Various valves and actuators 998 can be used to control the flow of fuel, and in some embodiments, air into the furnace. CPS 980 can be configured to control the valves and actuator so as to independently adjust primary-fuel flow, secondary fuel-flow and combustion-air flow. As will be realized, CPS 980 will comprise computer memory, a computer-processing unit and similar standard computer system components. CPS is utilized to calculate various of the conditions for the furnace and to adjust flow rates for primary fuel, secondary fuel and combustion air. For example, the AFT can be calculated based on fuel composition, and air quantities to minimize $NO_X$ can be calculated based on experimental curve data.

System 972 intercorrelates features of measurement, calculations, references to experimental data, and adjustment of the furnace system. System 972 provides for continuous sampling and measurement of constantly changing fuel composition gases (for example, natural gas, propane, hydrogen), followed by calculation or measurement of adiabatic flame temperature (AFT) and/or prediction emissions with further determination of excess air (EXA) required to operate a burner for getting minimum $NO_X$, CO or other emissions output.

The above system and processes are applicable to a variety of furnace (heater) systems. For example, the system and process can be used in a furnace system where all the combustion air is introduced with the primary fuel into a burner chamber utilizing a low flame anchoring.

The apparatuses, systems and methods of the current disclosure has been described in reference to the specific embodiments illustrated in the figures; however, the embodiments are not meant to be limited to those specific embodiments. As will be apparent to those skilled in the art, features of one embodiment are capable of being used in one of the other embodiments as long as they do not directly conflict with elements of the other embodiment. For example, the divergent tile of FIG. 7 can be used in association with any of the other embodiments as can the specific ignition unit disclosed for FIG. 7. Additionally for example, FIG. 19 illustrates a system for carrying out the process of FIG. 17. While FIG. 19 does not show a central air tube as illustrated in FIG. 6, those skilled in the art would realize based on this disclosure that the system and process described in FIGS. 17 and 19, could readily be adapted to control the flow of air through a central air tube such as illustrated in FIG. 6.

While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Additionally, where the term "about" is used in relation to a range it generally means plus or minus half the last significant figure of the range value, unless context indicates another definition of "about" applies.

Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A method of discharging fuel and an amount of air into a furnace space wherein the fuel is burned such that flue gases having low NOx content and low CO content are formed therefrom, the method comprises:

mixing a first portion of the fuel and substantially all of the air to form a lean primary fuel-air mixture;

discharging the lean primary fuel-air mixture into the furnace space within a primary combustion zone defined by a burner tile such that there is a furnace environment surrounding the burner tile;

burning the lean primary fuel-air mixture in the primary combustion zone to produce a flame and thus generated flue gases, wherein the primary combustion zone has a first end and a second end, and the lean primary fuel-air mixture is introduced so that the flame is anchored adjacent the first end and the generated flue gases are discharged into the furnace environment at the second end.

2. The method of claim 1, wherein the discharging of the lean primary fuel-air mixture is through at least one tube in which the first portion of the fuel and substantially all the air are mixed to form the fuel-air mixture, and wherein the first end of the combustion zone is closed to air introduction other than through the at least one tube.

3. The method of claim 1, further comprising introducing a second portion of fuel into the furnace outside of the primary combustion zone such that the second portion of fuel forms a secondary combustion zone downstream of the primary combustion zone and substantially all the air for the secondary combustion zone is provided by the lean primary fuel-air mixture.

4. The method of claim 3, wherein substantially all the air is at least 97% of the air needed for combustion of the fuel based on the air needed to combust the first portion of the fuel, and the second portion of the fuel.

5. The method of claim 3, further comprising:

determining the composition of the fuel;

determining a flow rate of the first portion of the fuel and a flow rate of the second portion of the fuel;

determining an adiabatic flame temperature (AFT) for the composition of the fuel;

determining the excess air quantity required to produce a predetermined NOx emission level based on the AFT; and based on the excess air quantity required to produce the predetermined NOx emission level, adjusting at least one of the flow rate of the first portion of fuel, the flow rate of the second portion of fuel, the amount of air, and the distribution of air within the burner.

6. The method of claim 5, wherein the step of adjusting comprises adjusting both the flow rate of the first portion of fuel and the flow rate of the second portion of the fuel.

7. The method of claim 6, wherein the flow rate of the first portion of the fuel and the flow rate of the second portion of the fuel are adjusted simultaneously.

8. The method of claim 7, wherein the discharging of the lean primary fuel-air mixture is through a plurality of tubes in which all the air for the primary combustion zone and secondary combustion zone, and the first portion of the fuel are mixed to form the fuel-air mixture, and wherein the fuel-air mixture is supplied to the first combustion zone only through the tubes.

* * * * *